US010900737B1

(12) United States Patent
Hensel et al.

(10) Patent No.: US 10,900,737 B1
(45) Date of Patent: Jan. 26, 2021

(54) RETRACTABLE COCKING ASSEMBLY FOR A CROSSBOW

(71) Applicant: Barnett Outdoors, LLC, Tarpon Springs, FL (US)

(72) Inventors: Jonathan Hensel, Tarpon Springs, FL (US); David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 16/674,206

(22) Filed: Nov. 5, 2019

Related U.S. Application Data

(60) Provisional application No. 62/755,933, filed on Nov. 5, 2018.

(51) Int. Cl.
*F41B 5/12* (2006.01)
*F41B 5/18* (2006.01)

(52) U.S. Cl.
CPC ..... *F41B 5/12* (2013.01); *F41B 5/123* (2013.01)

(58) Field of Classification Search
CPC ..... F41B 5/12; F41B 5/123
USPC ..... 124/25
See application file for complete search history.

(56) References Cited

U.S. PATENT DOCUMENTS

| | | | | |
|---|---|---|---|---|
| 5,791,322 | A * | 8/1998 | McPherson | F41B 5/10 124/25.6 |
| 6,286,496 | B1 * | 9/2001 | Bednar | F41B 5/123 124/25 |
| 6,705,304 | B1 * | 3/2004 | Pauluhn | F41B 5/12 124/25 |
| 9,958,232 | B1 * | 5/2018 | Egerdee | F41B 5/1403 |
| 10,458,743 | B1 * | 10/2019 | Kempf | F41B 5/12 |
| 2006/0086346 | A1 * | 4/2006 | Middleton | F41B 5/12 124/25 |
| 2008/0141989 | A1 * | 6/2008 | Ogawa | F41B 5/14 124/25 |
| 2016/0273870 | A1 * | 9/2016 | Pulkrabek | F41B 5/1469 |
| 2018/0242557 | A1 * | 8/2018 | Woods | A01K 27/001 |
| 2019/0011215 | A1 * | 1/2019 | Shaffer | F41B 5/148 |

* cited by examiner

*Primary Examiner* — John E Simms, Jr.
(74) *Attorney, Agent, or Firm* — Jones Walker LLP

(57) ABSTRACT

A retractable cocking assembly with hooks slidingly secured to a crossbow track. In a default or non-actuated position, the hooks are positioned forward of the uncocked bowstring. The hooks are drawn in a rearward direction to engage the bowstring and to pull the bowstring to its cocked position. When the bowstring is secured in a trigger catch in the cocked position, a user engages a release member that causes the hooks to return to the default position at the forward end of the crossbow track. A continuous force springs pull the hooks forward into the default position when the release member is engaged.

14 Claims, 29 Drawing Sheets

RETRACTABLE COCKING ASSEMBLY FOR A CROSSBOW

CROSS-REFERENCE TO RELATED APPLICATIONS

This application claims the benefit of and priority to U.S. Provisional Patent Application No. 62/755,933, filed on Nov. 5, 2018, which is incorporation by reference herein.

SUMMARY OF THE DISCLOSURE

The present disclosure is directed to an embodiment of crossbow with a retractable cocking assembly. This crossbow embodiment may include a stock having a forward end and a rearward end. The stock may include a top side, a bottom side, and left and right sides interconnecting the top and bottom sides. The crossbow embodiment may also include a track including a top side, a bottom side, and left and right sides interconnecting the top and bottom sides. The bottom side of the track may be operatively connected to the top side of the stock. The track may extend from a front end positioned at the forward end of the stock to a rear end extending rearward of a catch. The top side of the track may be configured to position a projectile for firing. The crossbow embodiment may also include a trigger assembly including a trigger. The trigger may be operatively associated with the catch. The catch may be operatively positioned above the track. The catch may be configured to retain a bowstring in a cocked position and to release the bowstring for firing the projectile. The crossbow embodiment may also include a riser operatively affixed at the forward end of the stock. The riser may include a left side section and a right side section. The crossbow embodiment may also include a first bow limb operatively connected to the left side section of the riser. The crossbow embodiment may also include a second bow limb operatively connected to the right side section of the riser. The bowstring may be operatively connected between the first and second bow limbs and traverse above the top side of the track. The crossbow embodiment may also include a retractable cocking assembly including a hook member and a return mechanism. The hook member may include a hook extension configured to retain the bowstring. The hook member may be slidably affixed to the track between a non-actuated position wherein the hook member is situated forward of the bowstring in an uncocked position and an actuated position wherein the hook member is situated adjacent the catch so that the catch retains the bowstring in the cocked position for firing. The return mechanism may include a biasing member. The biasing member may be operatively connected to the hook member and configured to move the hook member from the actuated position to the non-actuated position. The crossbow embodiment may also include a cocking device including a cord and a winding assembly. The cord may have a first end operatively connected to the winding assembly and a second end operatively connected to the hook member. The winding assembly may be configured to wind the cord to cause the hook member to move from the non-actuated position to the actuated position.

In another embodiment of the crossbow, the biasing member may include a spring. The spring may be a constant force spring. The spring may also be a clock spring. The clock spring may be formed of a spring steel.

In yet another embodiment of the crossbow, the biasing member may include a housing containing the spring.

In yet another embodiment of the crossbow, the spring may have a first end operatively connected within the housing and a second end operatively connected to the hook member.

In yet another embodiment of the crossbow, the housing may include a top section. The top section may be configured to operatively receive the hook member when the hook member is in the non-actuated position.

In yet another embodiment of the crossbow, the cocking device may include a release mechanism configured to release the cord so that the biasing member is able to move the hook member to the non-actuated position.

In yet another embodiment of the crossbow, the crossbow may further comprise a return assist assembly. The return assist assembly may comprise a push extension on the hook member. The push extension may be configured to receive a digit from a user. The user may push on the push extension to cause an initial forward movement of the hook member from the actuated position to enable the biasing member of the return mechanism to return the hook member to the non-actuated position.

In yet another embodiment of the crossbow, the hook member may be a first hook member slidably affixed to the right side of the crossbow track. The return mechanism may be a first return mechanism and the biasing member may be a first biasing member. The retractable cocking assembly may include a second hook member operatively associated with a second return mechanism. The second hook member may include a hook extension configured to retain the bowstring. The second hook member may be slidably affixed to the right side of the track between a non-actuated position wherein the second hook member is situated forward of the bowstring in the uncocked position and an actuated position wherein the second hook member is situated adjacent the catch so that the catch retains the bowstring in the cocked position for firing. The second return mechanism may include a second biasing member. The second biasing member may be operatively connected to the second hook member and configured to move the second hook member from the actuated position to the non-actuated position. The first hook member may include a first pulley and wherein the second hook member may include a second pulley. The cord may operatively extend from the winding assembly through the first pulley of the first hook member, through the crossbow track, through the second pulley of the second hook member, and back to the winding assembly so that winding of the cord causes the first and second hook members to move from the non-actuated position to the actuated position.

In an alternative embodiment of a crossbow with a retractable cocking assembly, the alternative crossbow may comprise a stock, a track, a trigger assembly, a riser, a first bow limb, a second bow limb, and a bowstring as described above with respect to the first crossbow embodiment. The alternative crossbow embodiment may include a retractable cocking assembly including a first hook member operatively associated with a first return mechanism and a second hook member operatively associated with a second return mechanism. The first and second hook members may each include a hook extension configured to retain the bowstring. The first hook member may be slidably affixed to the left side of the track between a non-actuated position wherein the first hook member is situated forward of the bowstring in an uncocked position and an actuated position wherein the first hook member is situated adjacent the catch so that the catch retains the bowstring in the cocked position for firing. The second hook member may be slidably affixed to the right side of the track between a non-actuated position wherein the second hook member is situated forward of the bowstring in the uncocked position and an actuated position wherein the second hook member is situated adjacent the catch so that the catch retains the bowstring in the cocked position for firing. The first return mechanism may include a first biasing member. The first biasing member may be operatively connected to the first hook member and configured to move the first hook member from the actuated position to the non-actuated position. The second return mechanism may include a second biasing member. The second biasing member may be operatively connected to the second hook member and configured to move the second hook member from the actuated position to the non-actuated position. The alternative crossbow embodiment may also include a cocking device including a first cord, a second cord and a winding assembly. The first and second cords may each have a first end operatively connected to the winding assembly and a second end. The second end of the first cord may be operatively connected to the first hook member. The second end of the second cord may be operatively connected to the second hook member. The winding assembly may be configured to wind the first and second cords to cause the first and second hook members to move from the non-actuated position to the actuated position.

In another embodiment of the alternative crossbow, the first and second hook members may each have a forward surface, a rearward surface, a top side, a bottom side, an outer side, and an inner side. The hook extension may extend from the top side.

In yet another embodiment of the alternative crossbow, the first and second hook members may each include a bore. The bore of the first hook member may be dimensioned to accommodate the second end of the first cord. The bore of the second hook member may be dimensioned to accommodate the second end of the second cord.

In yet another embodiment of the alternative crossbow, the bore in the first hook member may extend from the rearward surface of the first hook member and terminate adjacent a first pin groove. The first pin groove may retain a first pin. The second end of the first cord may be fixedly attached to the first pin. The bore in the second hook member may extend from the rearward surface of the second hook member and terminate adjacent a second pin groove. The second pin groove may retain a second pin. The second end of the second cord may be fixedly attached to the second pin.

In yet another embodiment of the alternative crossbow, the hook extension of each of the first and second hook members may have a front side, a rear side, an external side and an internal side. The first and second hook members may each include an insertion section extending inwardly from the internal side of the hook extension.

In yet another embodiment of the alternative crossbow, the left and right sides of the track may each include a first cavity defined by an internal cavity wall. The first cavity may extend from a point on the track forward of the bowstring in the uncocked position to at least a point on the track below the catch. The insertion section of the first hook member may be profiled for accommodation within the first cavity of the left side of the track and the insertion section of the second hook member may be profiled for accommodation within the first cavity of the right side of the track.

In yet another embodiment of the alternative crossbow, the profile of the insertion section of the first hook member may include an upper alignment plug positioned on the top side of the first hook member. An upper side of the internal cavity wall of the first cavity of the left side of the track may include a profile shaped to accommodate the upper alignment plug of the first hook member in sliding relationship. The profile of the insertion section of the second hook member may include an upper alignment plug positioned on the top side of the second hook member. An upper side of the internal cavity wall of the first cavity of the right side of the track may include a profile shaped to accommodate the upper alignment plug of the second hook member in sliding relationship.

In yet another embodiment of the alternative crossbow, the profile of the insertion section of the first hook member may include a lower alignment plug positioned on the bottom side of the first hook member. A lower side of the internal cavity wall of the first cavity of the left side of the track may include a profile shaped to accommodate the lower alignment plug of the first hook member in sliding relationship. The profile of the insertion section of the second hook member may include a lower alignment plug positioned on the bottom side of the second hook member. A lower side of the internal cavity wall of the first cavity of the right side of the track may include a profile shaped to accommodate the lower alignment plug of the second hook member in sliding relationship.

In yet another embodiment of the alternative crossbow, the upper and lower alignment plugs of the first and second hook members may each include an outer sleeve.

In yet another embodiment of the alternative crossbow, the bore of the first hook member may be positioned within the insertion section of the first hook member. The bore of the second hook member may be positioned within the insertion section of the second hook member.

In yet another embodiment of the alternative crossbow, the cocking device may include a release mechanism configured to release the first and second cords so that the first and second biasing members are able to move the first and second hook members to the non-actuated position.

In yet another embodiment of the alternative crossbow, the crossbow may further comprise a return assist assembly. The return assist assembly may comprise a push extension on each of the first and second hook members. Each push extension may be configured to receive a digit from a user. The user may push on the push extension of each of the first and second hook members to cause an initial forward movement of the first and second hook members from the actuated position to enable the first and second biasing members of the return mechanism to return the first and second hook members to the non-actuated position.

In yet another embodiment of the alternative crossbow, the first biasing member may include a first spring. The second biasing member may include a second spring.

In yet another embodiment of the alternative crossbow, the first and second springs may each be a constant force spring.

In yet another embodiment of the alternative crossbow, the first and second springs may each be a clock spring.

In yet another embodiment of the alternative crossbow, the clock spring may be formed of a spring steel.

In yet another embodiment of the alternative crossbow, the first biasing member may include a first housing containing the first spring. The second biasing member may include a second housing containing the second spring.

In yet another embodiment of the alternative crossbow, the first spring of the first biasing member may have a first end operatively connected within the first housing and a second end operatively connected to the first hook member. The second spring of the second biasing member may have a first end operatively connected within the second housing and a second end operatively connected to the second hook member.

In yet another embodiment of the alternative crossbow, the first housing may include a first top section. The first top section may be configured to operatively receive the first hook member when the first hook member is in the non-actuated position. The second housing may include a second top section. The second top section may be configured to operatively receive the second hook member when the second hook member is in the non-actuated position.

DETAILED DESCRIPTION OF THE DISCLOSURE

A crank cocking device ("CCD") may be used to cock a crossbow to draw a crossbow string from a default position into a cocked position using a cocking mechanism. A user rotates a receptacle of the CCD to draw the hooks rearward to engage the bow string and to draw the hooks with the bow string to a catch to place the crossbow in a cocked position. The CCD may provide an automatic stop. If a user stops rotating the receptacle of the CCD, the hooks may remain stationary (i.e., the weight of the bow string does not pull the hooks forward).

A retractable cocking assembly may be secured to a crossbow stock. Hooks of the retractable cocking assembly may be slidingly secured to a track of the crossbow. In a default position, the hooks are positioned forward of the bow string. The hooks may be drawn in a rearward direction to engage the bowstring and to pull the bowstring to a cocked position. When the bowstring is secured in a trigger catch in a cocked position, a user may engage a release member that causes the hooks to be returned to the default position at the forward end of the crossbow track. The retractable cocking assembly may include a continuous force spring that pulls the hooks forward into the default position when the release member is engaged. In this way, the hooks remain attached to the crossbow stock, but do not interfere with the crossbow string when the crossbow is fired. The retractable cocking assembly may be used in connection with the any type of cocking device, including a crank cocking device (CCD) or a worm gear CCD, which provides an automatic stop when a user discontinues the rotation of the receptacle of the worm gear CCD.

The retractable cocking assembly may further include a return assist assembly. The return assist assembly is helpful to overcome any pinching effect on the hooks caused by the narrower angle of the bowstring in the trigger catch. The return assist assembly may comprise extensions on the hooks configured for placement of a user's thumbs so that the user may push the hooks forward when the release member is engaged. Alternatively, the return assist assembly may comprise a spring assembly disposed within the crossbow track near the trigger catch configured to assist the initial forward movement of the hooks when the release member is engaged. The hooks may engage a pin of the spring assembly when the hooks are drawn rearward during the cocking process. As the hooks are further drawn in the rearward direction, the pin of the spring assembly travels with the hooks, thereby expanding a tension spring. When the release member is engaged, the tension spring of asserts an additional forward force on the hooks to cause the hooks to move in a forward direction along the crossbow track to return to the default position near the forward end of the crossbow.

Figure 1:
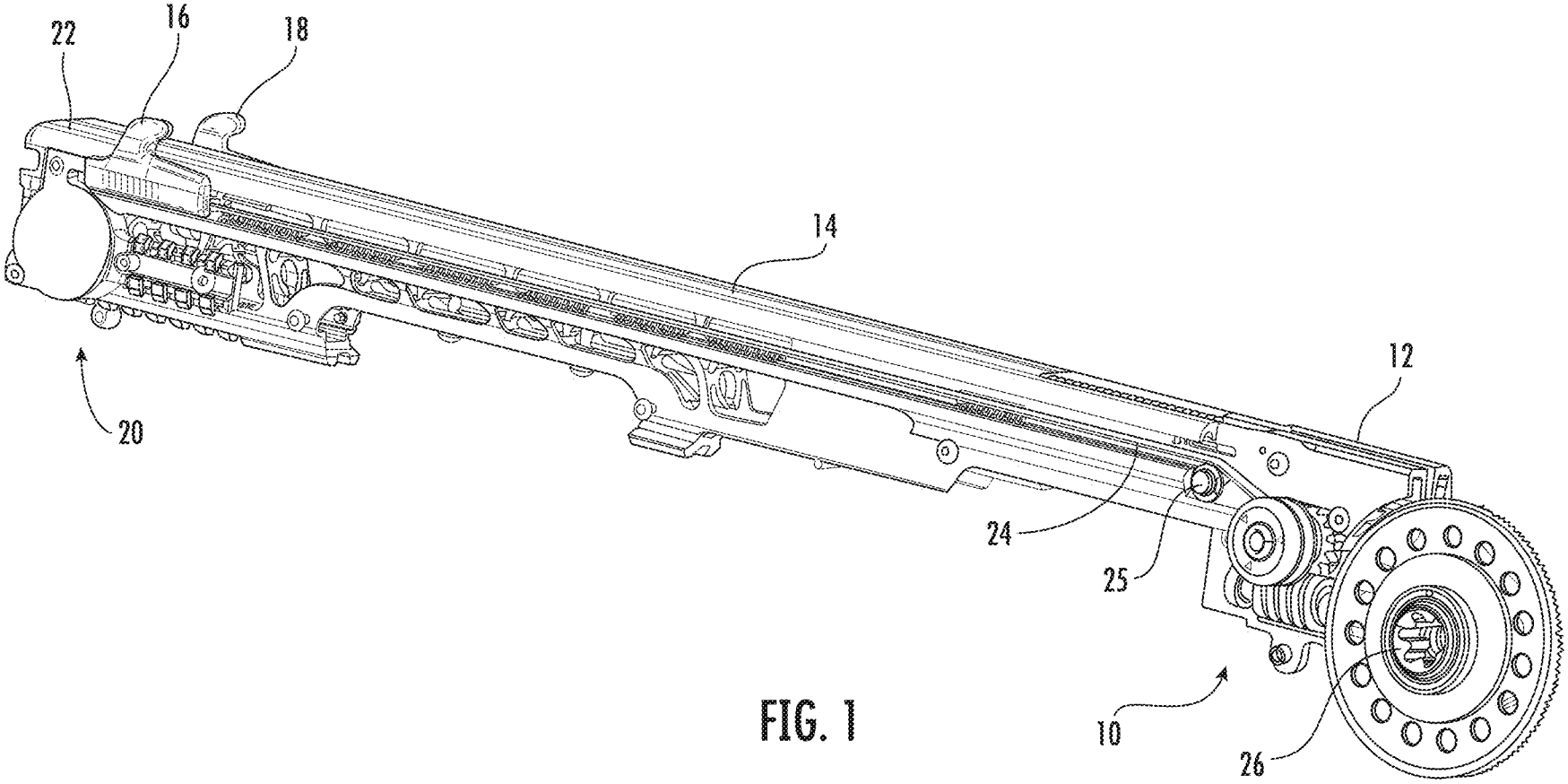
FIG. 1 is a perspective view of a crank cocking device ("CCD") and a retractable cocking assembly on a crossbow track.

FIG. 1 illustrates an example of a crank cocking device (CCD) and a retractable cocking assembly with a crossbow track. CCD 10 is disposed near a rear end 12 of crossbow track 14. Hooks 16 and 18 of retractable cocking assembly 20 are slidingly secured to a first side and a second side of crossbow track 14, respectively. Hooks 16 and 18 are positioned near front end 22 of crossbow track 14 in the default position shown in FIG. 1. Hooks 16 and 18 engage the crossbow string and pull the crossbow string from the front end 22 of crossbow track 14 to a cocked position closer to rear end 12 of crossbow track 14. Cord 24 is connected to hook 16 and a similar cord is connected to hook 18. Each cord connects to CCD 10. In one embodiment, each cord engages a guide 25 between hooks 16 and 18 and the CCD 10. A user engages receptacle 26 to rotate CCD 10, which winds cord 24 around spool members of CCD 10 to pull hooks 16 and 18 toward rear end 12 of crossbow track 14.

Figure 2:
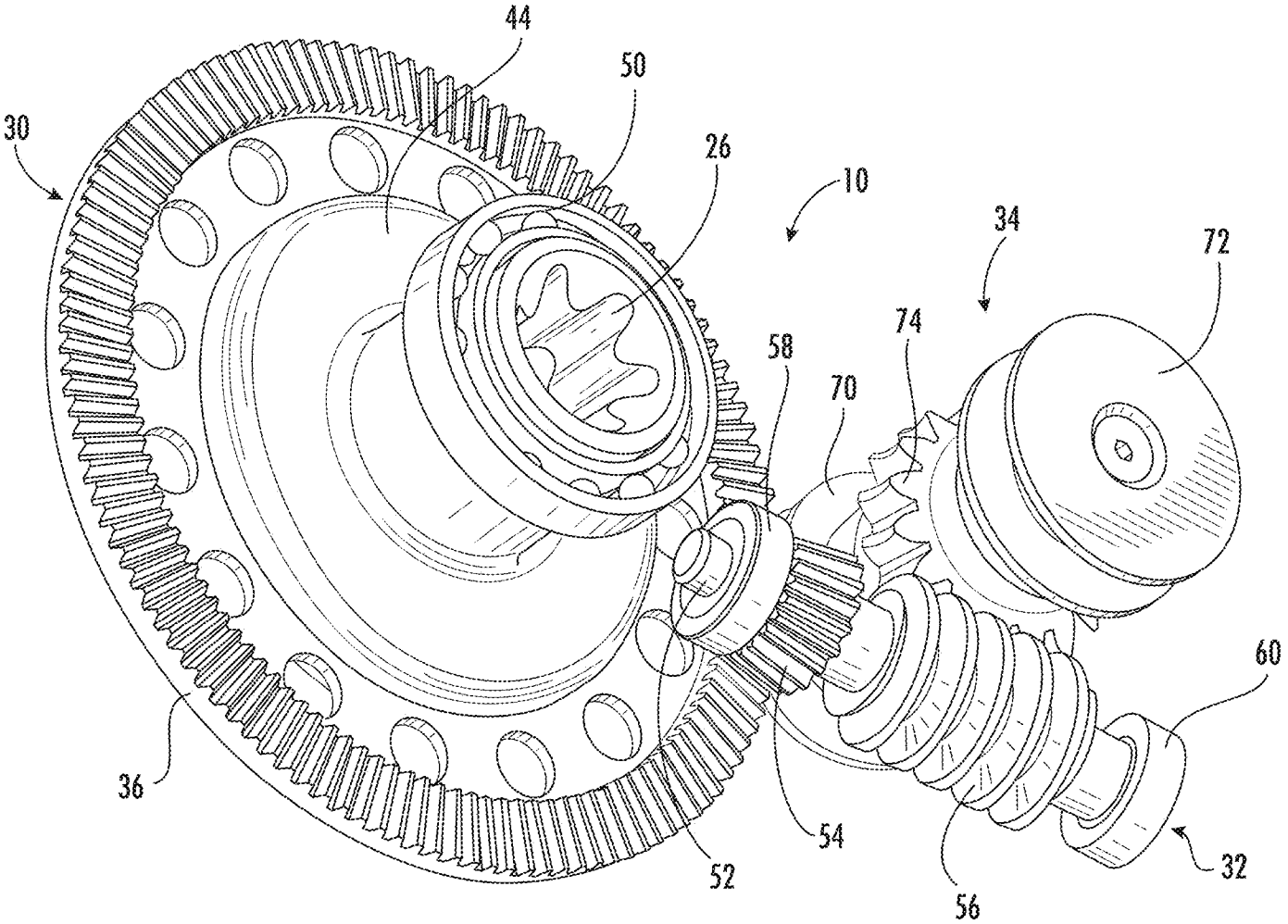
FIG. 2 is a perspective view of the CCD.
Figure 3:
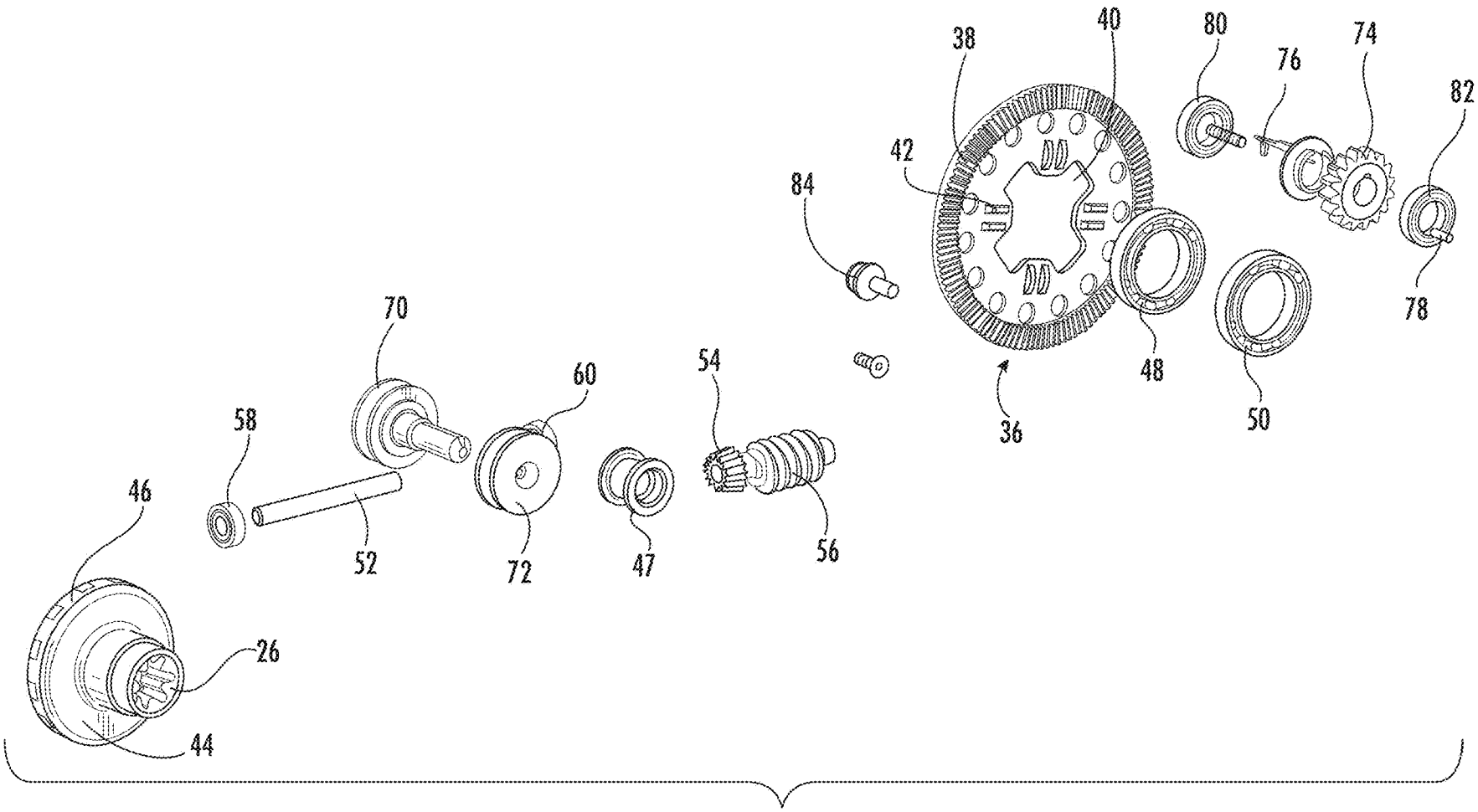
FIG. 3 is an exploded view of the CCD.

With reference to FIGS. 2 and 3, CCD 10 includes primary gear assembly 30, worm assembly 32, and spool assembly 34. Primary gear assembly 30 includes primary gear plate 36. Primary gear plate 36 includes gear profile surface 38 along a circumference of its front surface. Primary gear plate 36 also includes central opening 40 and a plurality of projections 42 on the front surface between central opening 40 and gear profile surface 38. Primary gear frame 44 is disposed through central opening 40 of primary gear plate 36. Primary gear frame 44 may include extended diameter central portion 46 including receptacles to engage projections 42 of primary gear plate 36. In this way, primary gear plate 36 may be rotationally locked to primary gear frame 44.

Figure 4:
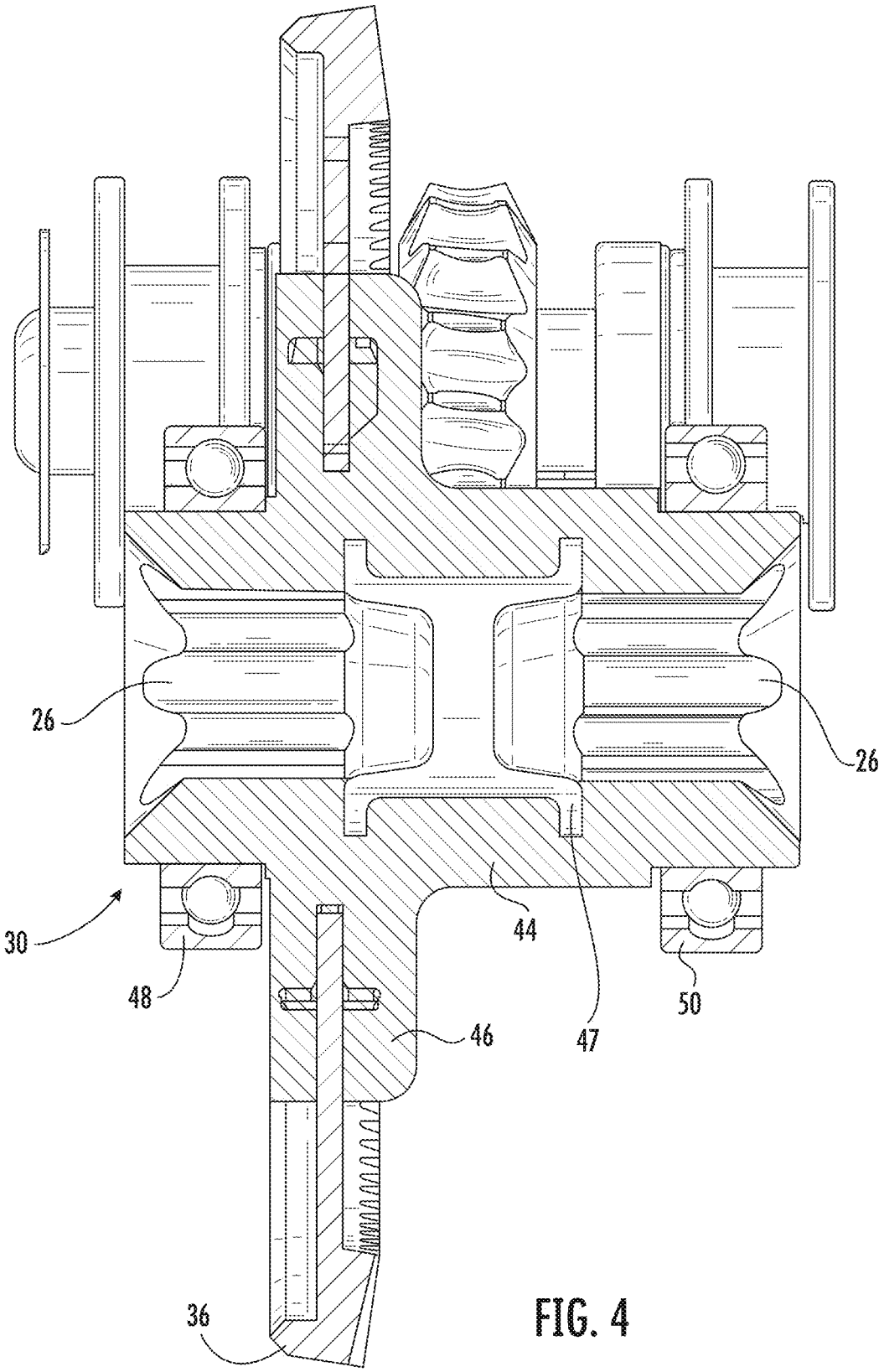
FIG. 4 is a sectional view of a primary gear assembly of the CCD.

Referring now to FIGS. 2-4, primary gear frame 44 also includes a central bore including receptacle profile 26 near both outer ends of the central bore. Receptacle profile 26 is configured to receive and engage a reciprocal profile of a crank handle to allow a user to rotate primary gear frame 44 and, in turn, rotate primary gear plate 36. Plug 47 is disposed within the central bore of primary gear frame 44. Plug 47 serves to seal the central bore of primary gear frame 44. Primary gear assembly 30 further includes bearings 48 and 50 disposed around outer ends of primary gear frame 44. Bearings 48 and 50 facilitate the rotation of primary gear frame 44 relative to a housing in which CCD 10 is disposed.

Figure 5:
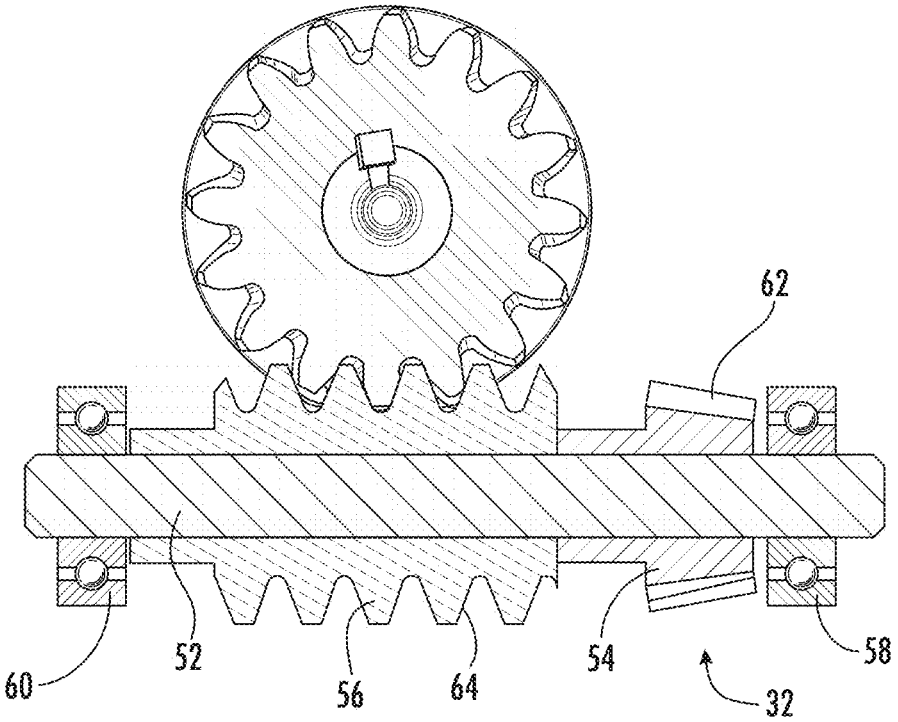
FIG. 5 is a sectional view of a worm assembly of the CCD.

With reference to FIGS. 2, 3, and 5, worm assembly 32 of CCD 10 includes axle 52, secondary gear sleeve 54, worm sleeve 56, and bearings 58 and 60. Secondary gear sleeve 54 includes an outer surface having a gear profile portion 62 and a central bore. Axle 52 is disposed through the central bore of secondary gear sleeve 54. Gear profile 62 engages gear profile surface 38 of primary gear plate 36. In this way, rotation of primary gear assembly 30 causes secondary gear sleeve 54 and axle 52 to rotate. Worm sleeve 56 includes a worm outer surface 64 and a central bore. Axle 52 is disposed through the central bore of worm sleeve 56. Rotation of axle 52 causes rotation of worm sleeve 56. In this way, rotation of primary gear assembly 30 causes rotation of worm assembly 32 and worm sleeve 56. Bearings 58 and 60 each includes a central bore, with axle 52 disposed therethrough. Bearings 58 and 60 facilitate the rotation of worm assembly 32 relative to a housing in which CCD 10 is disposed. In one embodiment, secondary gear sleeve 54 and worm sleeve 56 are integrally formed. In another embodiment, secondary gear sleeve 54, worm sleeve 56, and axle 52 are all integrally formed.

Figure 6:
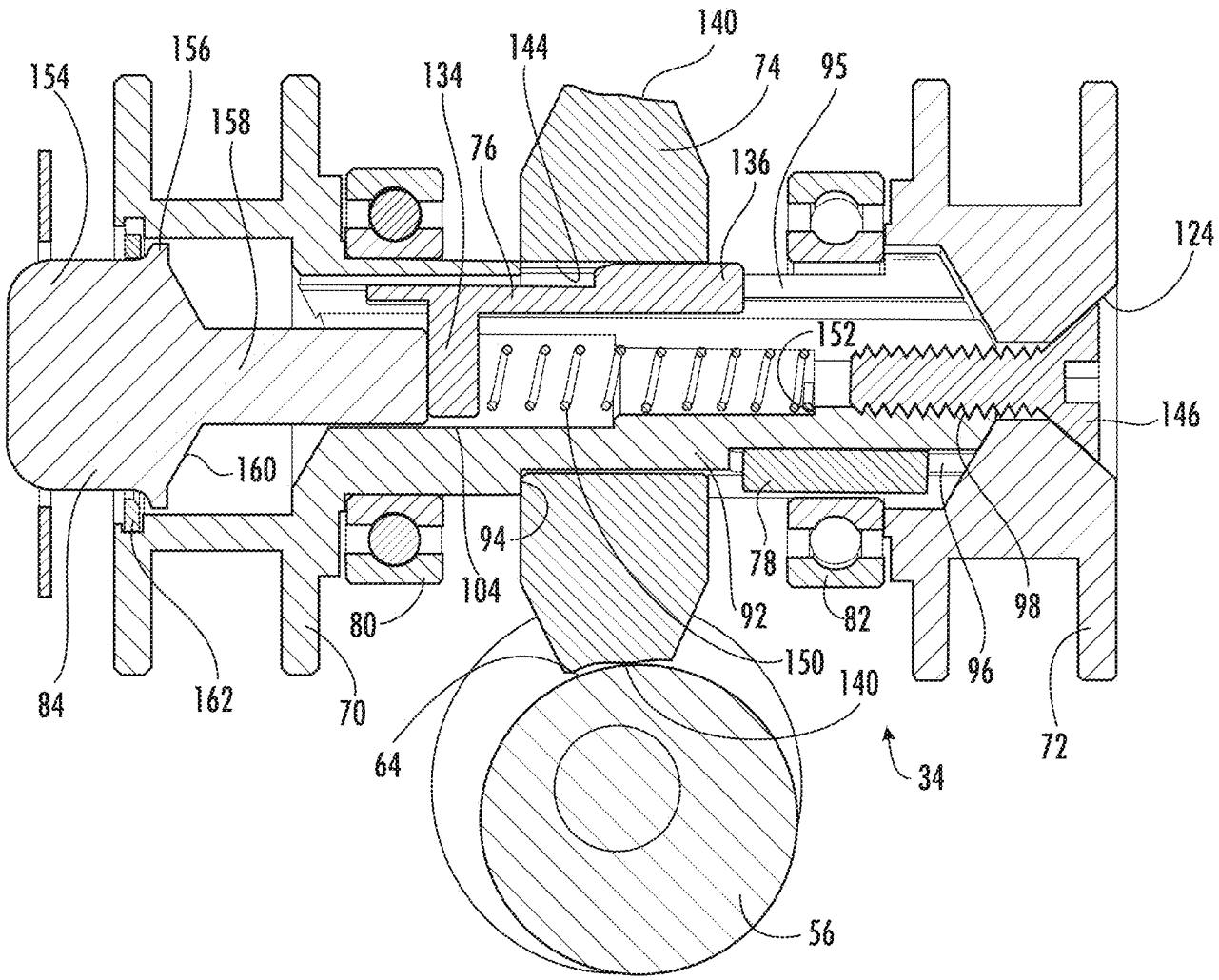
FIG. 6 is a sectional view of a spool assembly of the CCD.

Referring now to FIGS. 2, 3, and 6, spool assembly 34 of CCD 10 includes first spool member 70, second spool member 72, spool gear 74, key 76, alignment pin 78, bearings 80 and 82, and release member 84.

Figure 7:
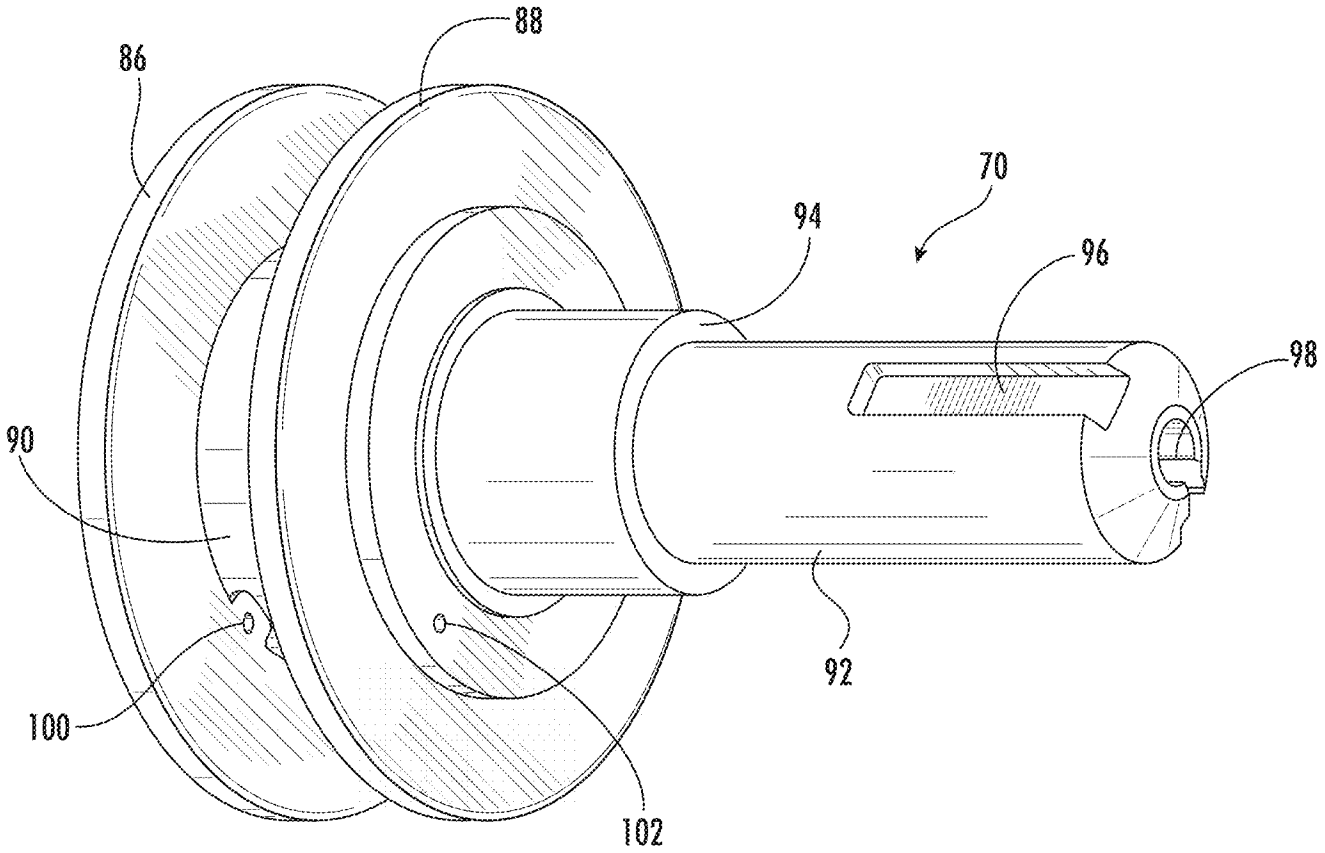
FIG. 7 is a perspective view of a first spool member of the spool assembly.
Figure 8:
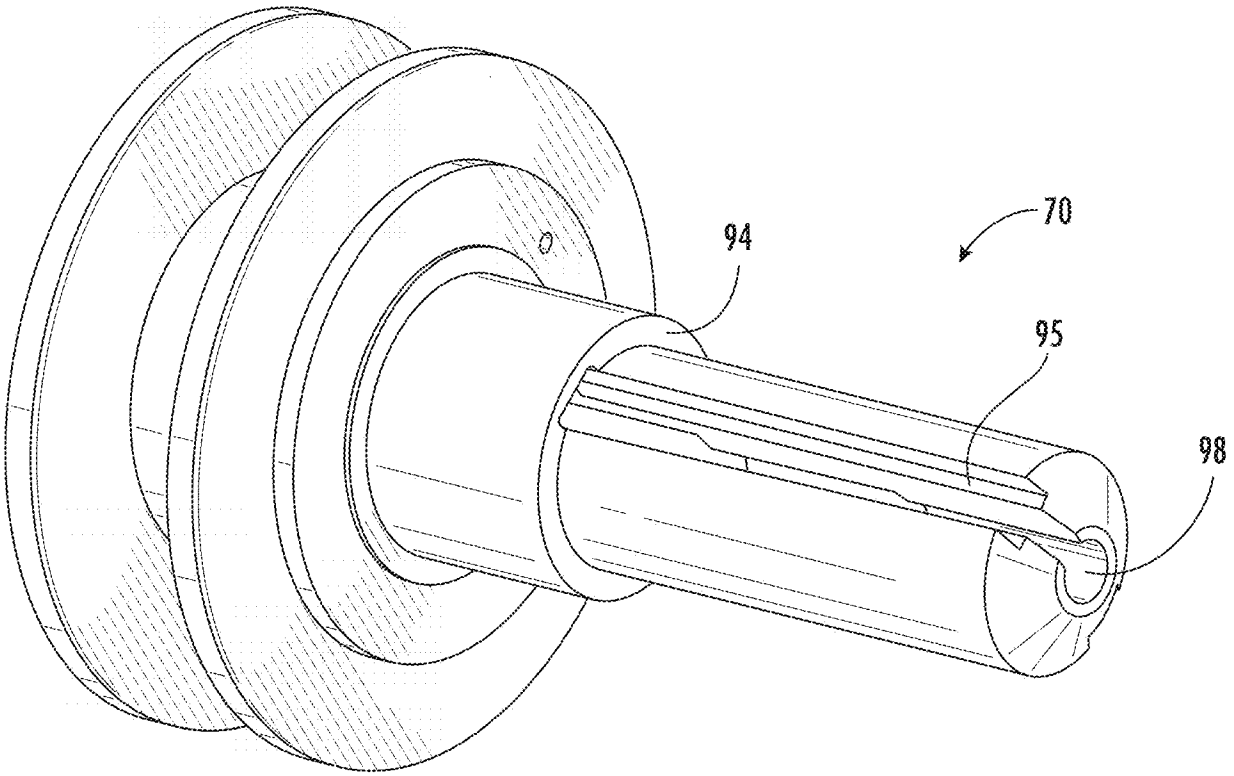
FIG. 8 is another perspective view of the first spool member.
Figure 9:
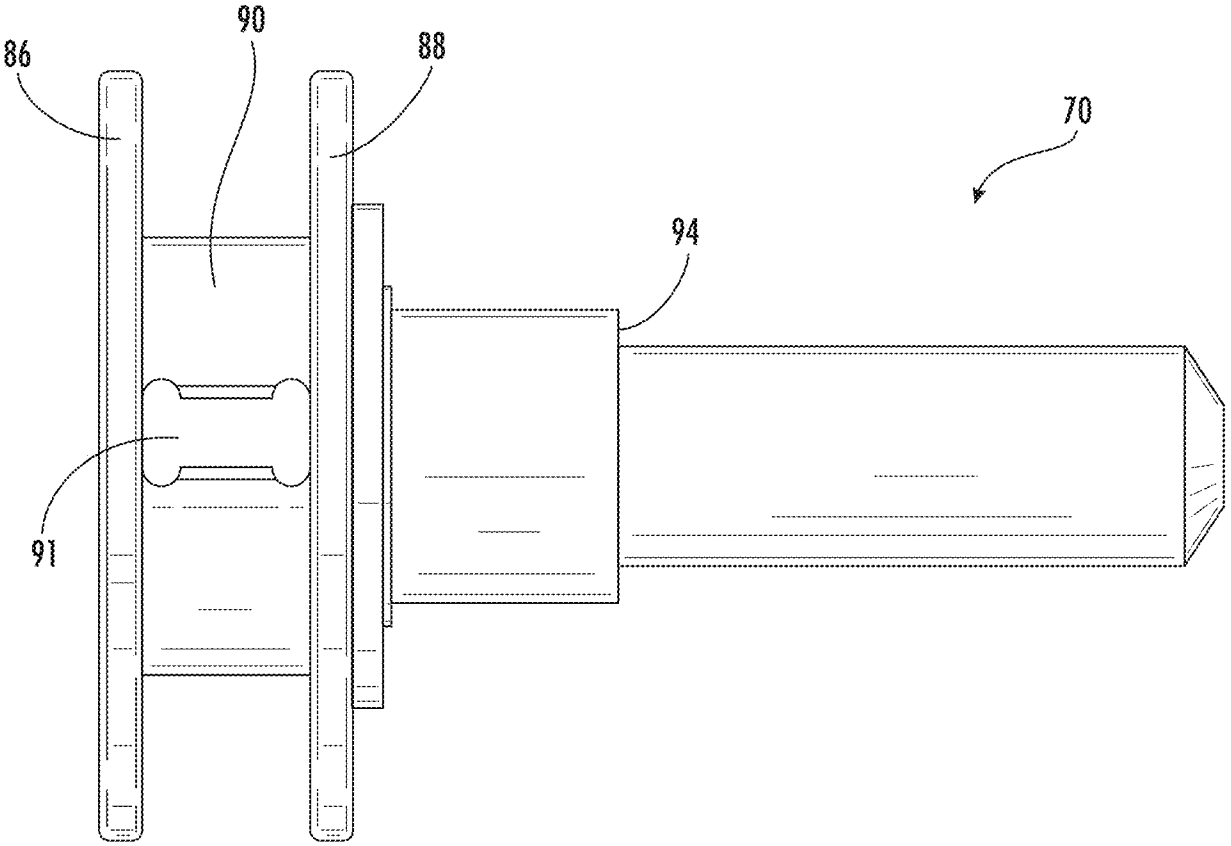
FIG. 9 is a top view of the first spool member.

With reference to FIGS. 7-9, first spool member 70 includes flanges 86 and 88 separated by spool surface 90, which includes inset portion 91. First spool member 70 also includes tubular extension 92 including a generally round profile having shoulder 94, slot 95 extending from shoulder 94 to a terminal end of tubular extension 92, and groove 96 in the outer surface of tubular extension 92 near its terminal end. In one embodiment, slot 95 and groove 96 may be disposed about 180 degrees apart. First spool member 70 also includes terminal opening 98. In one embodiment, terminal opening 98 includes a threaded inner profile. Flanges 86 and 88 each includes pin aperture 100 and 102, respectively. Inner bore 104 extends through first spool member 70 (as shown in FIG. 6).

Figure 10:
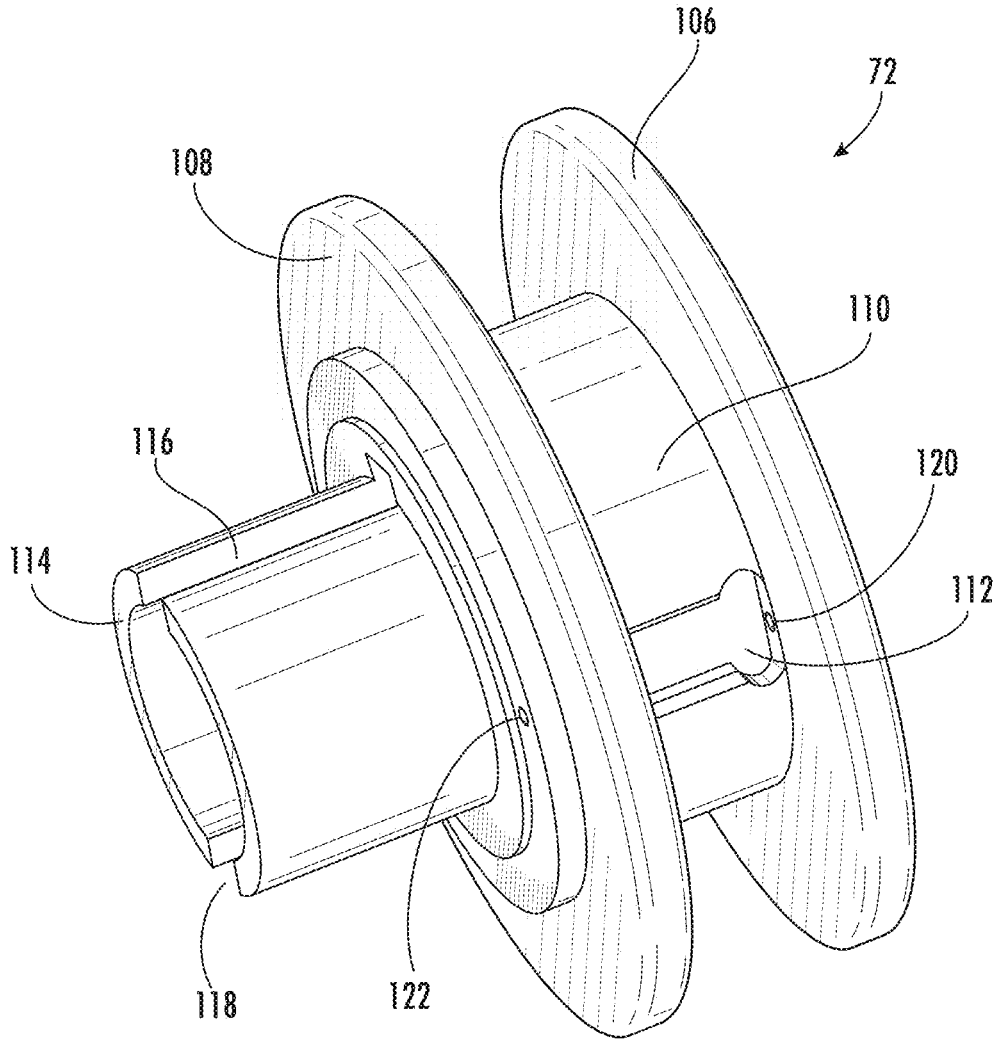
FIG. 10 is a perspective view of a second spool member of the spool assembly.
Figure 11:
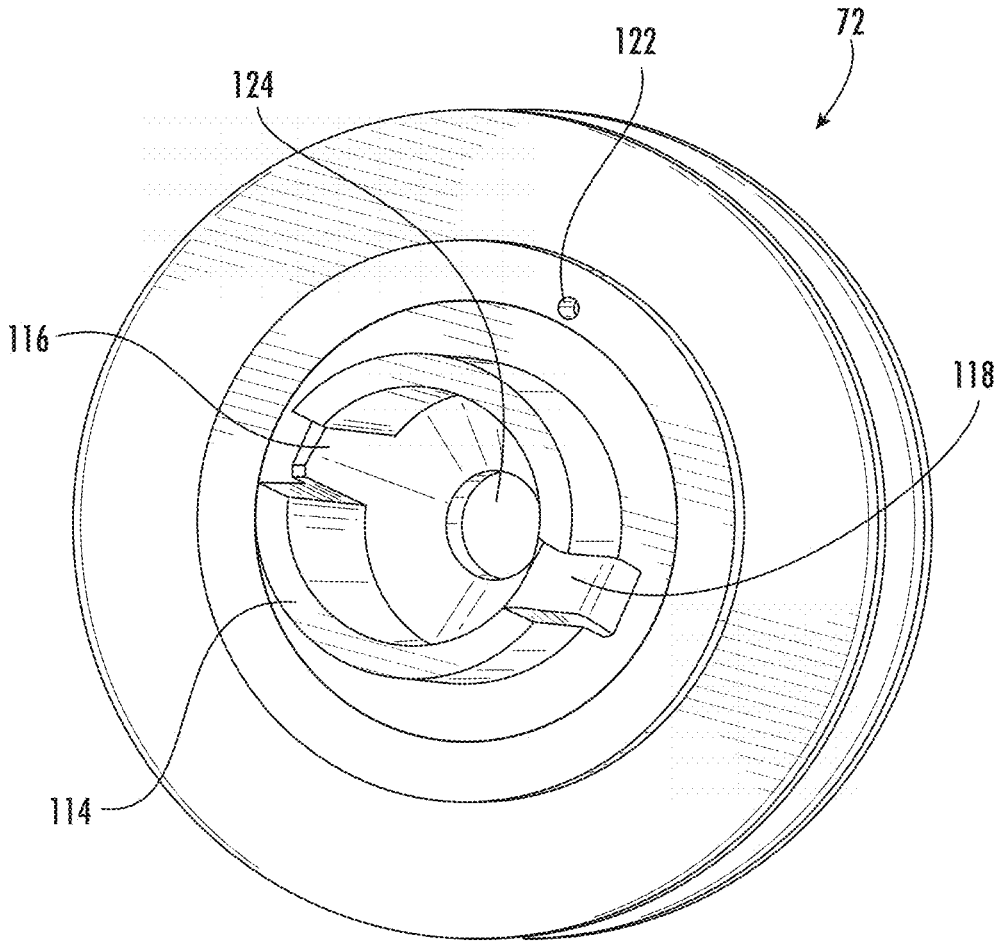
FIG. 11 is another perspective view of the second spool member.
Figure 12:
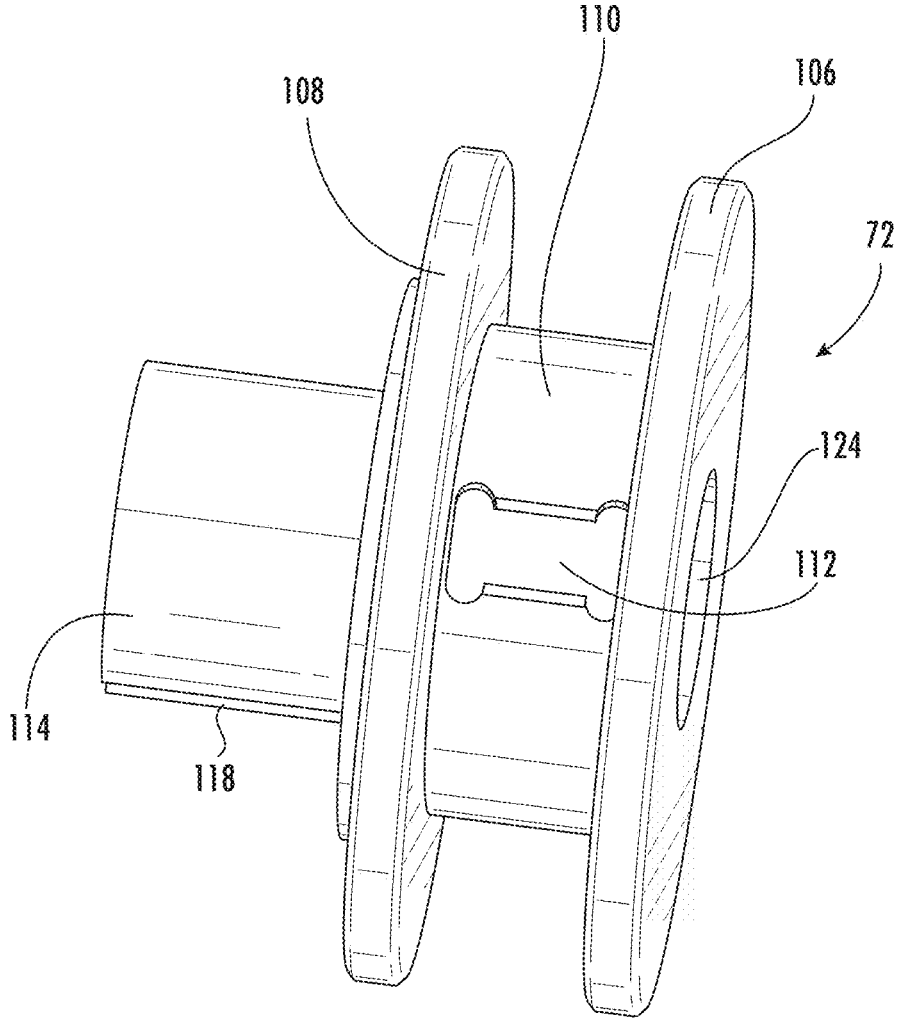
FIG. 12 is a top perspective view of the second spool member.

With reference now to FIGS. 10-12, second spool member 72 includes flanges 106 and 108 separated by spool surface 110, which includes inset portion 112. Second spool member 72 may include cylindrical extension 114 including slots 116 and 118. In one embodiment, slots 116 and 118 may be disposed about 180 degrees apart. Flanges 106 and 108 each includes pin aperture 120 and 122, respectively. Inner bore 124 extends through second spool member 72.

Figure 13:
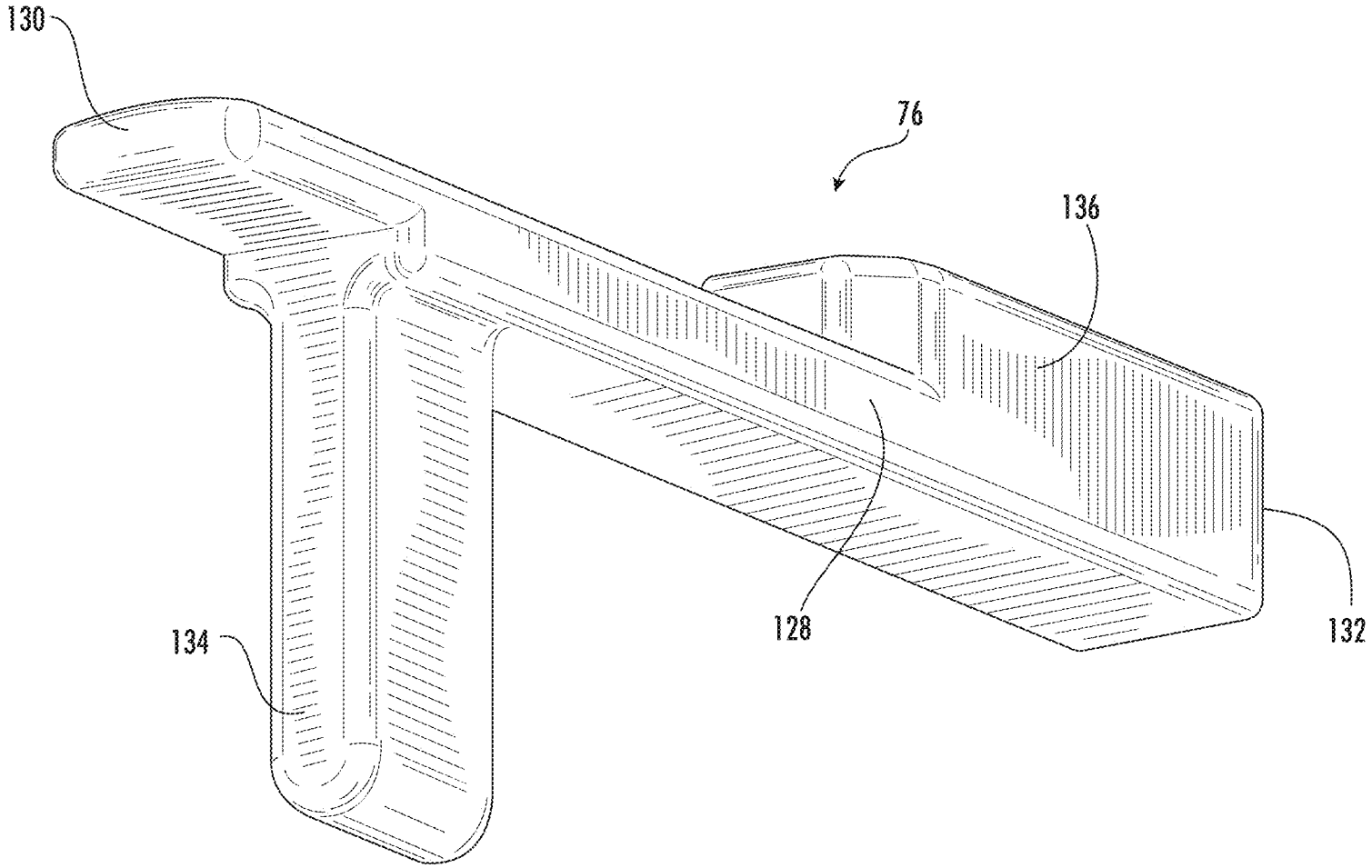
FIG. 13 is a perspective view of a key of the spool assembly.
Figure 14:
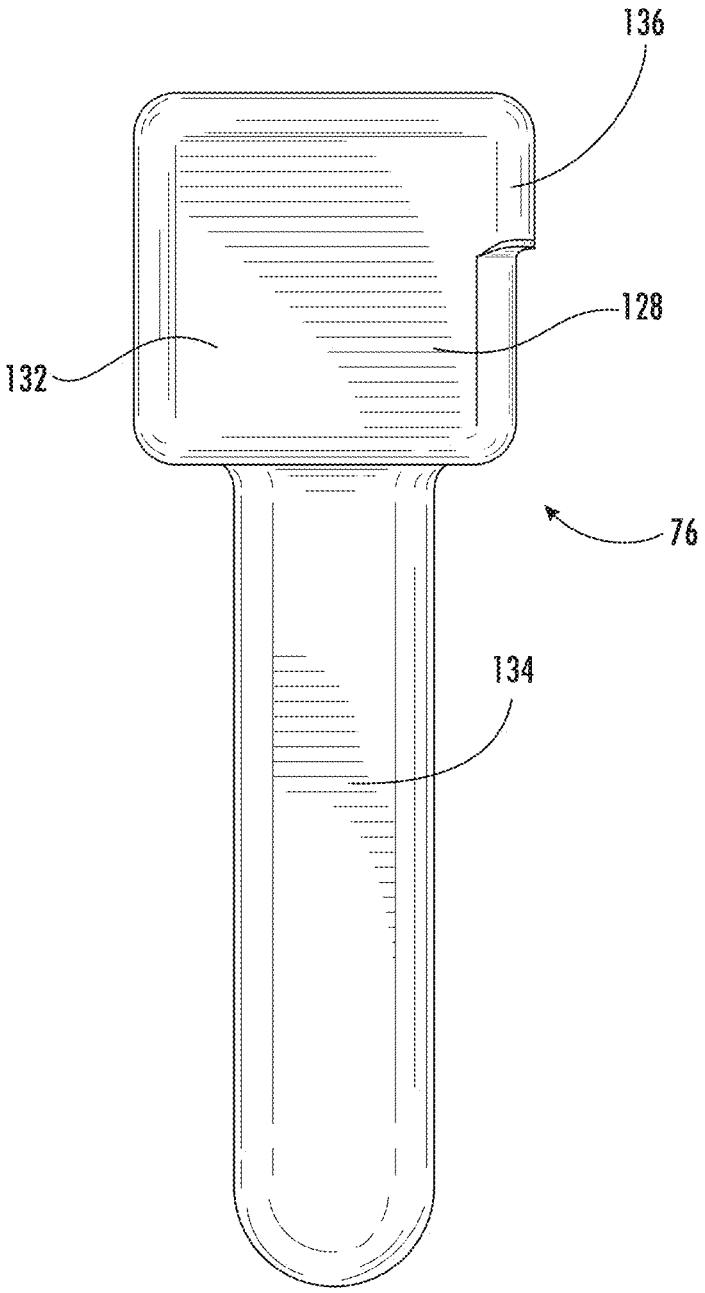
FIG. 14 is a side view of the key.

Referring now to FIGS. 13-14, key 76 includes a generally box shaped body 128 extending from first end 130 to second end 132. Protrusion 134 near first end 130 extends in a transverse direction from body 128. Block section 136 near second end 132 extends in an opposite transverse direction from body 128.

Figure 15:
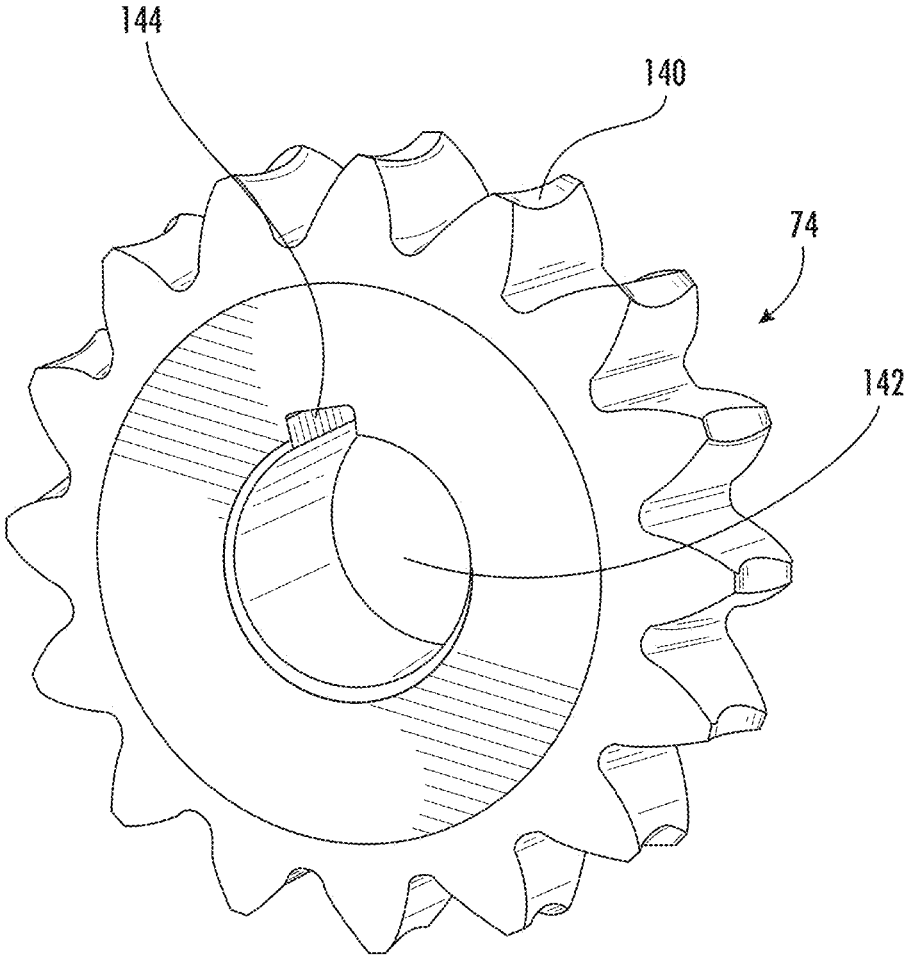
FIG. 15 is a perspective view of a spool gear of the spool assembly.

With reference to FIG. 15, spool gear 74 is generally plate shaped and includes worm gear outer surface 140 and central bore 142 including notch 144. Worm gear outer surface 140 includes a plurality of gear teeth configured to engage worm outer surface 64 on worm sleeve 56.

Referring again to FIG. 6, second spool member 72 may be secured to first spool member 70 by positioning screw 146 through inner bore 124 of second spool member 72 and engaging the threaded surface of terminal opening 98 of first spool member 70. Alignment pin 78 may be secured in groove 96 of first spool member 70 and in one of slots 116 or 118 of second spool member 72 to rotationally lock first and second spool members 70 and 72 together. In other words, second spool member 72 rotates with first spool member 70; second spool member 72 does not rotate relative to first spool member 70. Spool gear 74 and bearings 80 and 82 are secured around tubular extension 92 of first spool member 70. Bearing 80 is disposed adjacent to flange 88 of first spool member 70, and bearing 82 is disposed adjacent to flange 108 of second spool member 72. Bearings 80 and 82 facilitate the rotation of spool assembly 34 relative to a housing in which CCD 10 is disposed. Spool gear 74 is disposed between shoulder 94 on tubular extension 92 of first spool member 70 and a distal end of cylindrical extension 114 of second spool member 72.

Key 76 is partially disposed within inner bore 104 of first spool member 70 with block section 136 slidingly disposed in slot 95. Spring 150 is also disposed in inner bore 104 of first spool member 70 and biased between protrusion 134 of key 76 and inner shoulder 152 of inner bore 104. In this way, spring 150 biases key 76 toward the flanges of first spool member 70. Release member 84 is also at least partially disposed within inner bore 104 of first spool member 70. Release member 84 includes a generally round profile. Release member 84 includes contact block 154, shoulder 156, and plug 158. Shoulder 156 and plug 158 may be connected by tapered profile 160. The distal end of plug 158 engages protrusion 134 of key 76, and spring 150 and protrusion 134 bias release member 84 outward. Retaining ring 162 is disposed in a circumferential groove in inner bore 104 of first spool member 70. Release member 84 is retained within inner bore 104 by the interaction of shoulder 156 of release member 84 with retaining ring 162. Contact block 154 of release member 84 may extend outward from inner bore 104 of first spool member 70.

In the default position illustrated in FIG. 6, block section 136 of key 76 extends through slot 95 of first spool member 70 and engages notch 144 of spool gear 74 to rotationally lock spool gear 74 to first and second spool members 70 and 72. In this way, rotation of spool gear 74 causes rotation of spool members 70 and 72 in the default position.

Figure 16:
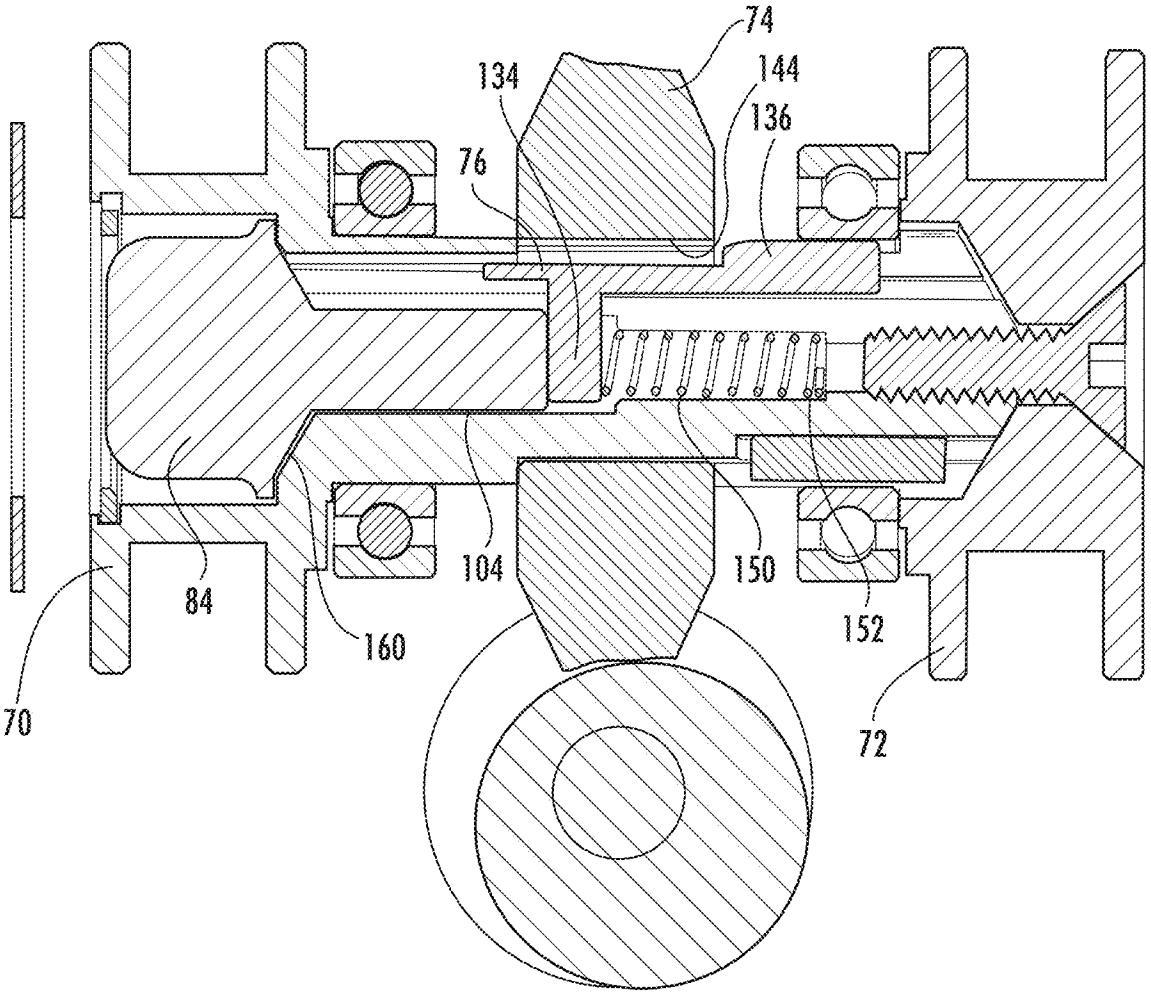
FIG. 16 is a sectional view of the spool assembly in a compressed position.

With reference now to FIG. 16, release member 84 may be pushed further into inner bore 104 of first spool member 70 as shown. Pushing release member 84 in this direction forces protrusion 134 of key 76 in the same direction, thereby compressing spring 150 against inner shoulder 152 of inner bore 104 of first spool member 70. This displacement of key 76 removes block section 136 of key 76 from notch 144 of spool gear 74, thereby enabling first and second spool members 70 and 72 to rotate relative to spool gear 74. In one embodiment, release member 84 may only be pushed further into inner bore 104 of first spool member 70 when there is no rotational load on spool members 70 and 72. This safety mechanism may be effected in a number of ways, such as by the frictional forces associated with the contact between block section 136 of key 76 and notch 144 of spool gear 74.

Figure 17:
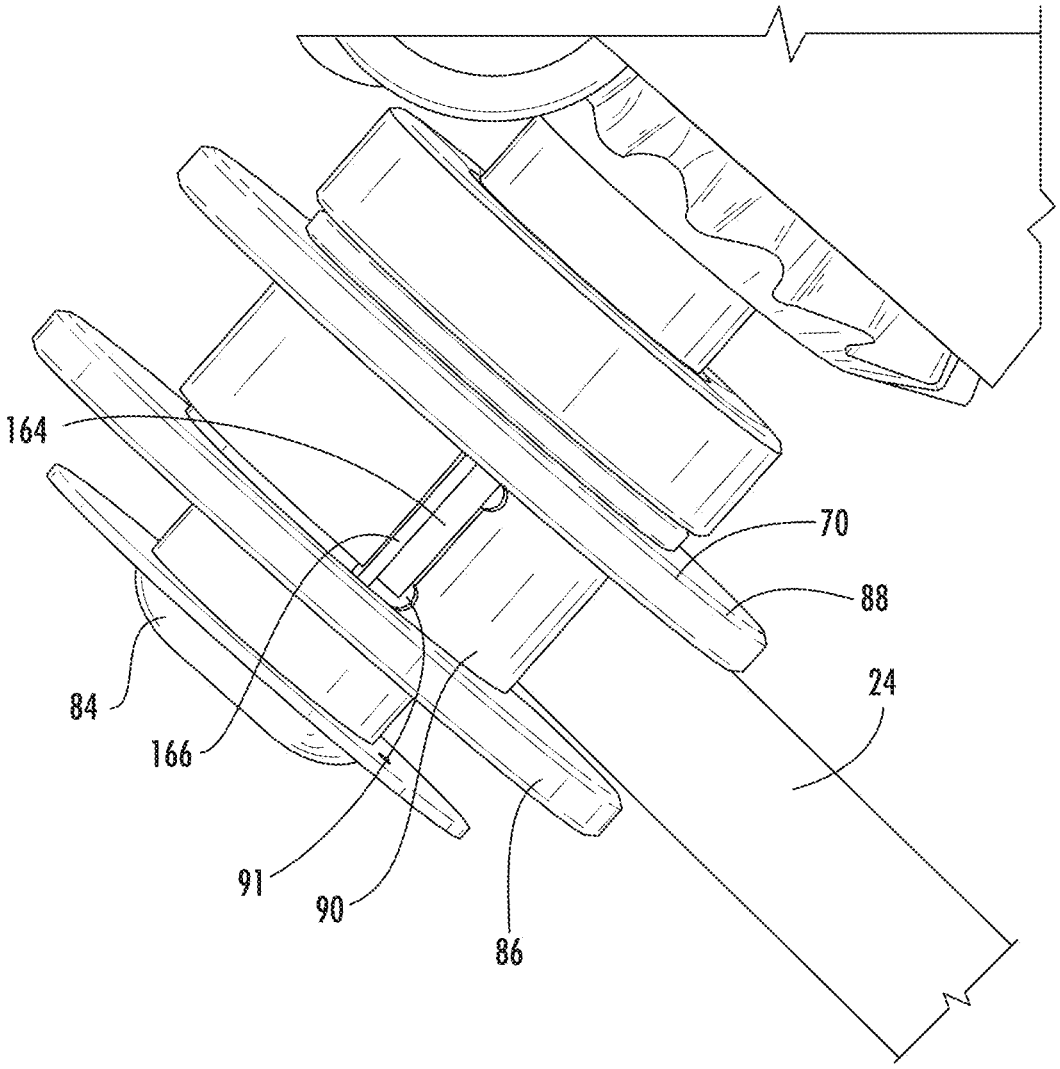
FIG. 17 is a perspective view of a cord of the retractable cocking assembly secured to the first pool member.

FIG. 17 illustrates the connection of cord 24 to first spool member 70. First end 164 of cord 24 is secured to spool surface 90 near inset surface 91 using pin 166, which is secured through pin apertures 100 and 102 in flanges 86 and 88, respectively. As first spool member 70 is rotated, cord 24 is wound around spool surface 90. When first spool member 70 is rotated in the opposite direction, cord 24 is unwound from spool surface 90.

Figure 18:
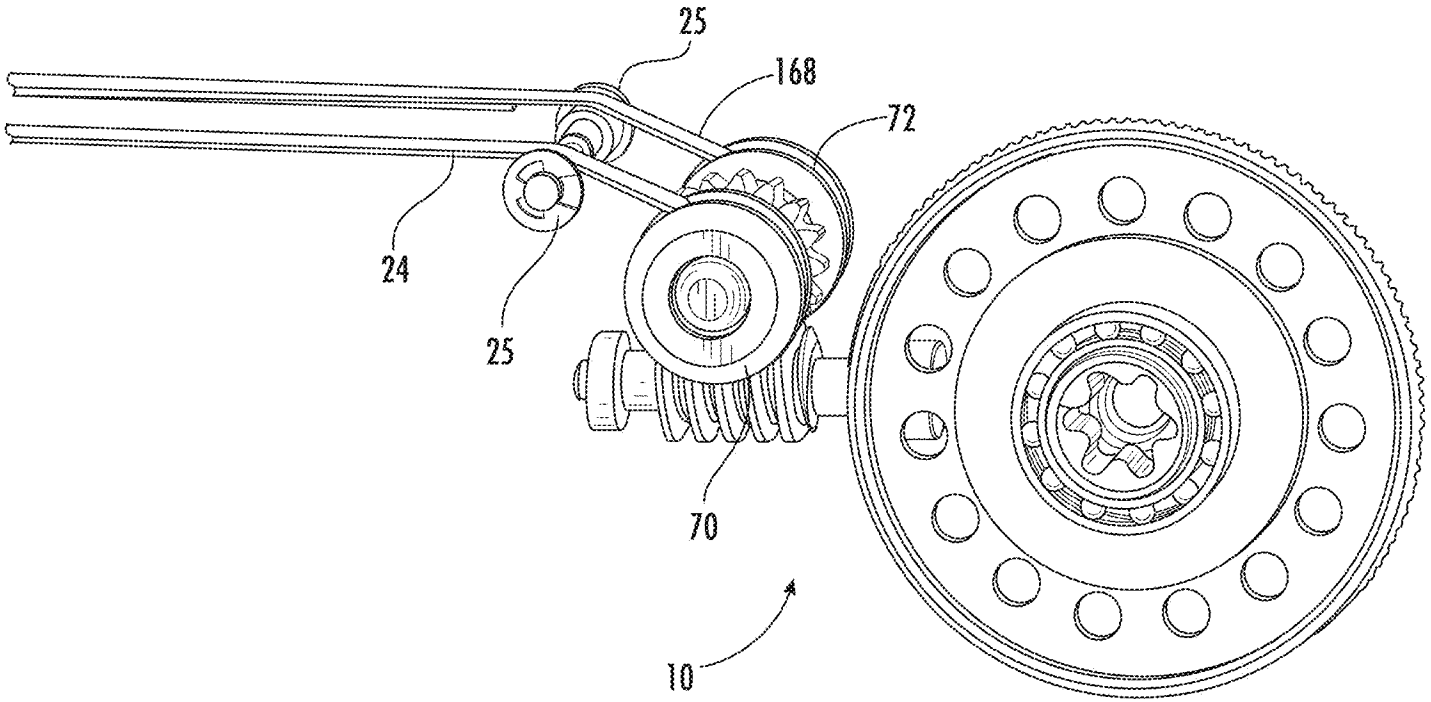
FIG. 18 is a perspective view of the cords of the retractable cocking assembly engaging a guide and the first spool member and the second spool member.

FIG. 18 illustrates CCD 10 along with cord 24 secured to first spool member 70 and second cord 168 secured to second spool member 72. Guides 25 position cords 24 and 168 at a proper angle for engaging spool members 70 and 72, respectively. Cords 24 and 168 may each be formed of any non-stretching material, including but not limited to a polymer or a metal. Cords 24 and 168 may have a profile shape that is rectangular, circular, round, oblong, or any other shape. In one embodiment, cords 24 and 168 have a rectangular profile with a thickness less than ½ of an inch, preferably less than 0.05 inches. In one embodiment, cords 24 and 168 have a rectangular profile with a thickness of about 0.03 inches.

Figure 19:
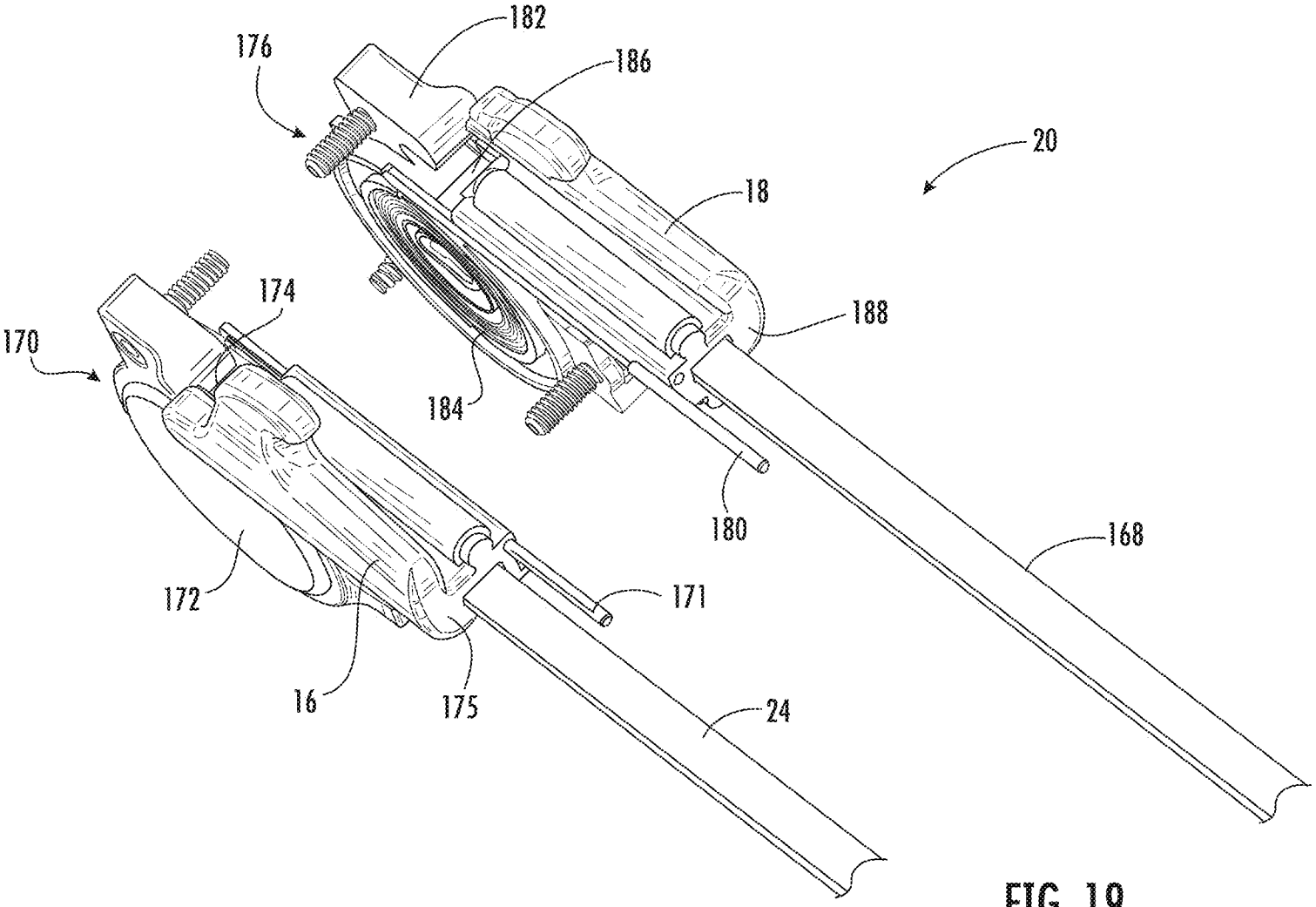
FIG. 19 is a perspective view of the retractable cocking assembly.

Referring now to FIG. 19, retractable cocking assembly 20 may include hook 16, spring assembly 170, cord 24, and pin 171. Spring assembly 170 may include cover 172 and a spring (not shown in this view) housed within cover 172. A distal end of the spring attaches to forward surface 174 of hook 16 (also shown in FIG. 20). Cord 24 is secured to hook 16, and extends from rearward surface 175 of hook 16. Retractable cocking assembly 20 may also include hook 18, spring assembly 176, cord 168, and pin 180, each being reciprocal to the analogous parts associated with hook 16. Spring assembly 176 may include cover 182 and spring 184 housed within cover 182. The spring of spring assembly 170 may include the same features as spring 184. A distal end of spring 184 attaches to forward surface 186 of hook 18. Second cord 168 is secured to hook 18, and extends from rearward surface 188 of hook 18. Spring assemblies 170 and 176 may be secured to a crossbow stock near a forward end such that the springs of spring assemblies 170 and 176 bias hooks 16 and 18 toward the forward end of the crossbow stock. The spring of spring assembly 170 and spring 184 of spring assembly 176 may be formed of constant force springs. In one embodiment, these springs are formed of clock springs formed of spring steel. However, the springs may be formed of any spring configured to bias hooks 16 and 18 in a forward direction.

Figure 20:
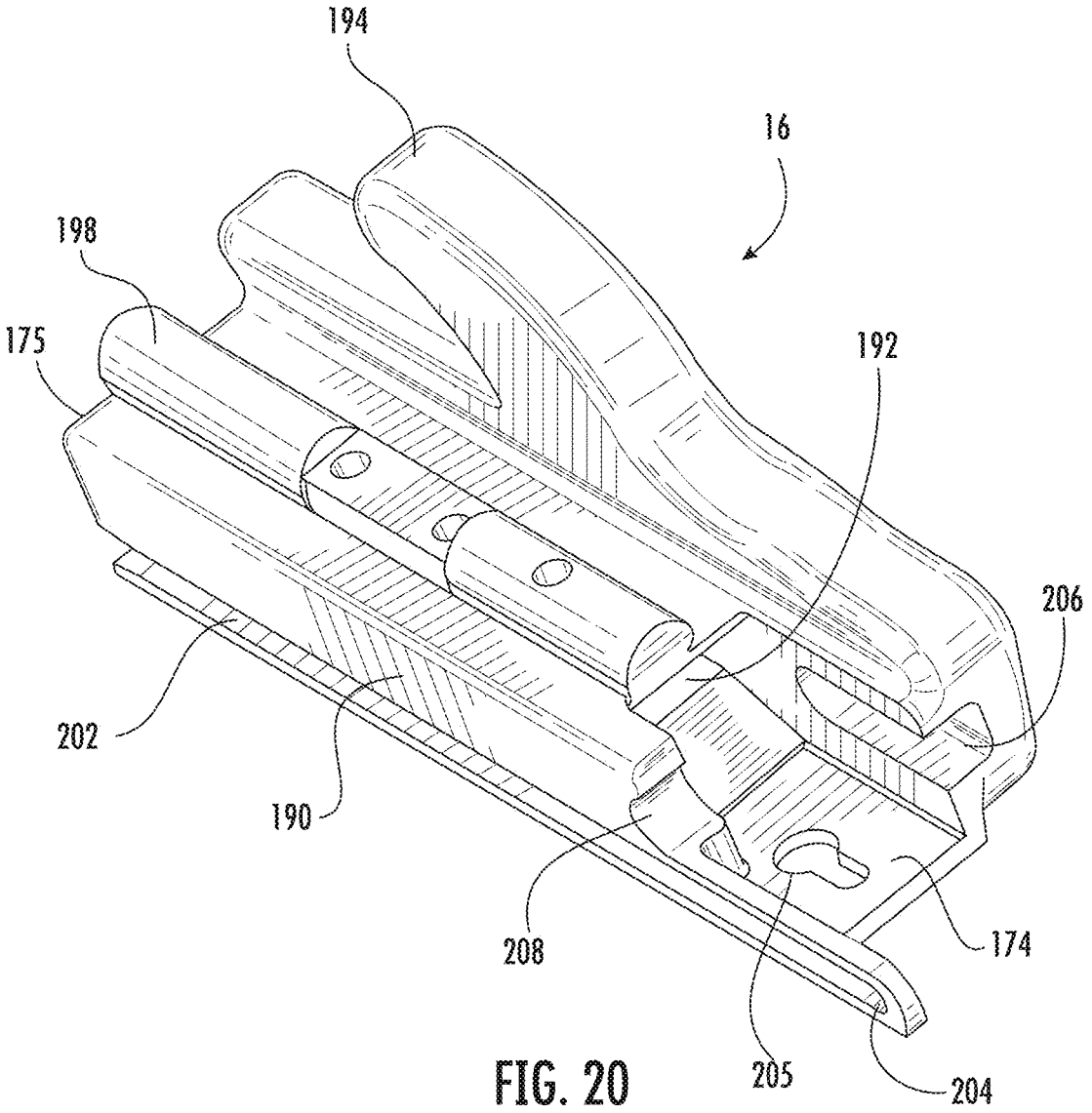
FIG. 20 is a perspective view of a hook member of the retractable cocking assembly.
Figure 21:
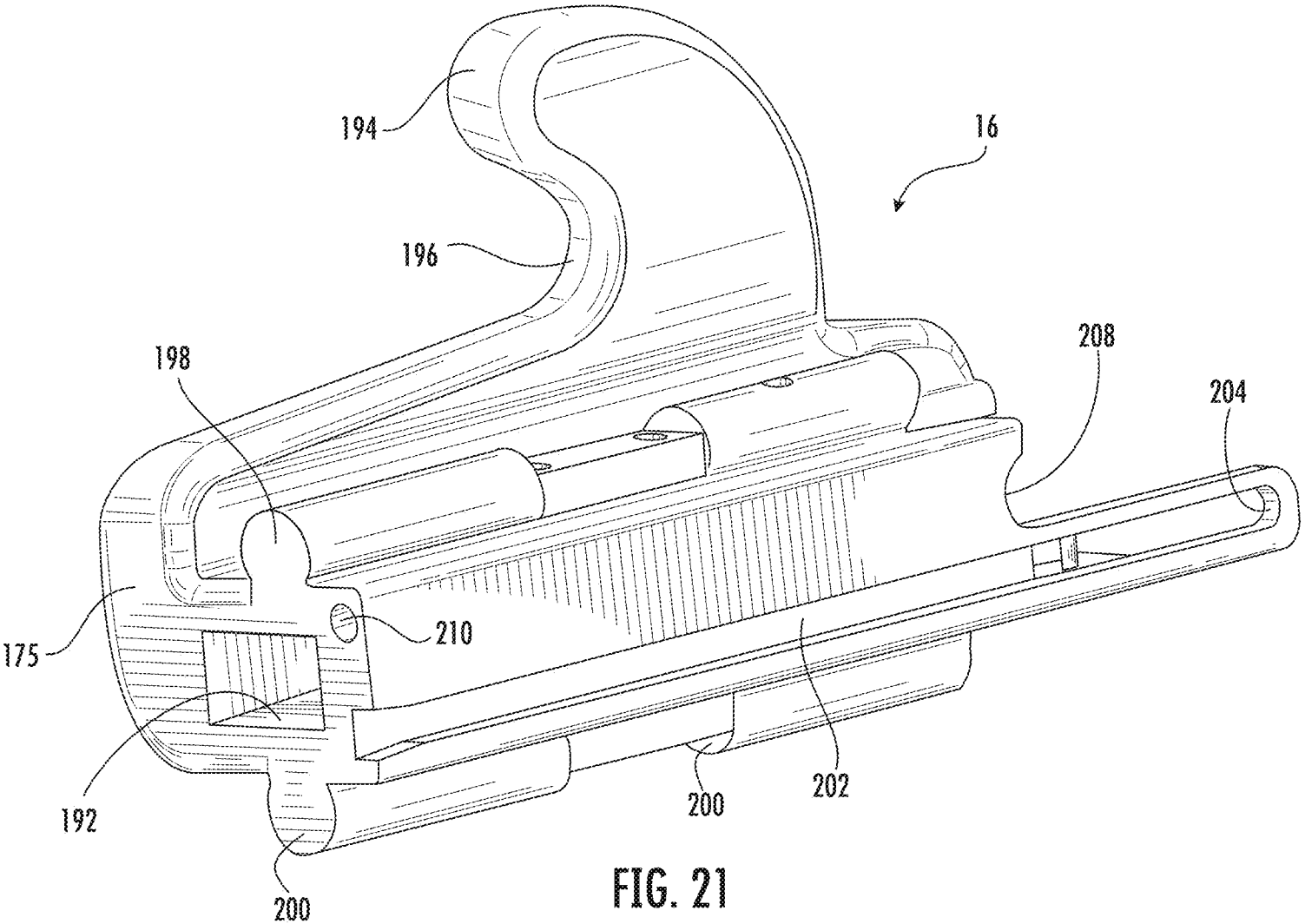
FIG. 21 is another perspective view of the hook member.

With reference to FIGS. 20 and 21, hook 16 includes body 190 having longitudinal bore 192 extending from rearward surface 175 to forward surface 174. Bore 192 may have any profile, such as square, rectangular, round, or oval. Hook extension 194 extends from an outer edge of body 190. Hook extension 194 creates hook surface 196 configured to contact and retain a crossbow string for cocking the crossbow. Upper alignment plug 198 extends along an upper surface of body 190 and lower alignment plug 200 extends along a lower surface of body 190. Upper and lower alignment plugs 198 and 200 may be continuous along the upper and lower surface of body 190. Alternatively, plugs 198 and 200 may include a cut out portion as shown.

Hook 16 may also include longitudinal groove 202 along an inside surface of body 190. Longitudinal groove 202 may extend from rearward surface 175 past forward surface 174 to stop surface 204. Forward surface 174 may include opening 205 configured to receive a fixation mechanism (e.g., bolt, screw, pin) to secure the distal end of the spring in spring assembly 170 to forward surface 174 of hook 16. Hook 16 may further include pin groove 206 on the outside wall of hook 16 and pin groove 208 on the inside wall of hook 16, both near forward surface 174. Pin grooves 206 and 208 may be vertically aligned with longitudinal bore 192. Rearward surface 175 of hook 16 includes pin bore 210 configured to retain one end of pin 171 as shown in FIG. 19. Hook 18 includes the same features as hook 16 in a reciprocal orientation, such that hook 18 may be positioned on the opposite side of a crossbow track.

Figure 22:
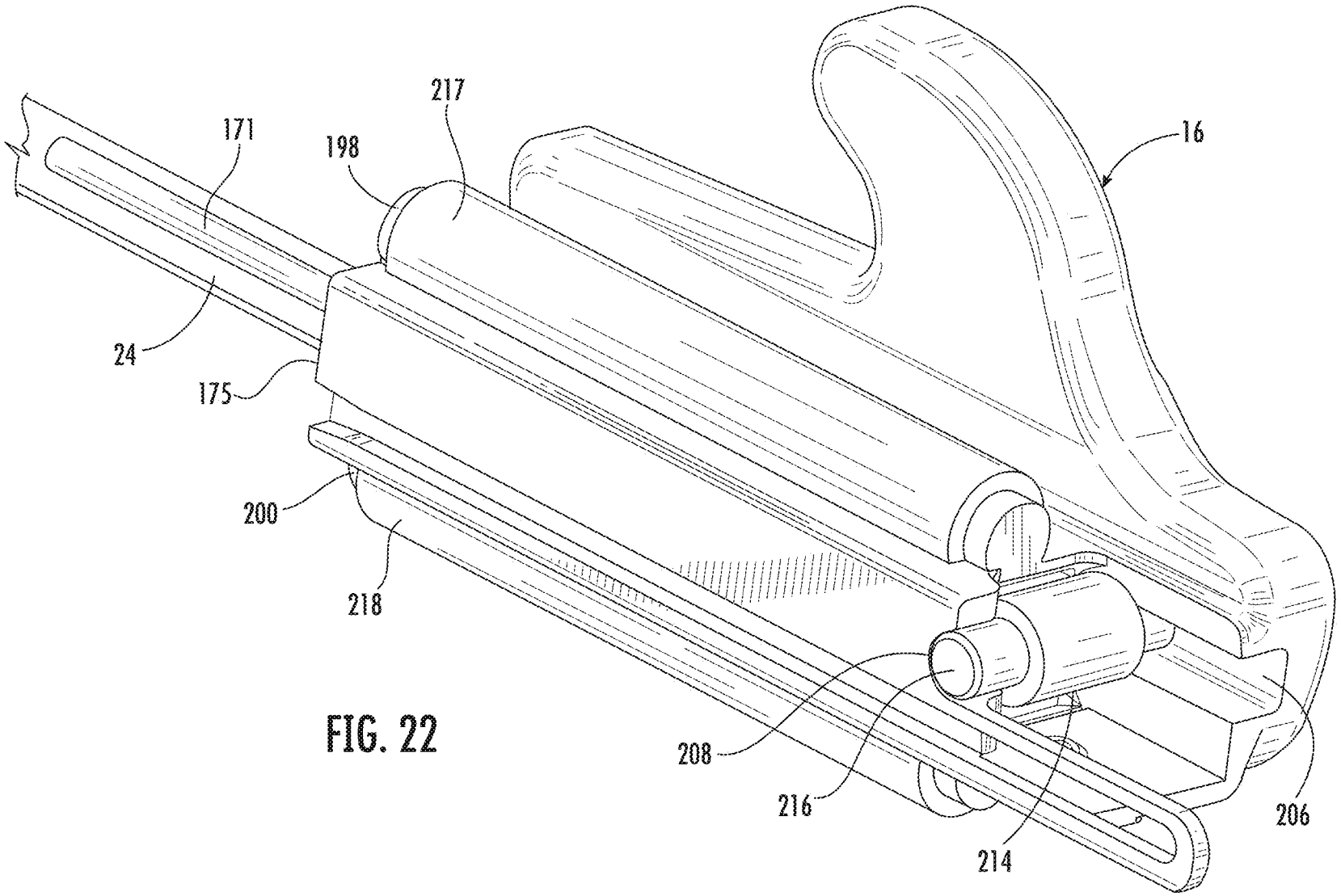
FIG. 22 is a perspective view of the cord secured to the hook member.

FIG. 22 illustrates the connection of cord 24 to hook 16. Second end 214 of cord 24 is secured to pin 216. One end of pin 216 is secured in pin groove 206, and the other end of pin 216 is secured in pin groove 208. Cord 24 extends from second end 214 connected to pin 216, through longitudinal bore 192, and beyond rearward end 175 of hook 16. Accordingly, cord 24 extends from hook 16 to first spool member 70 (as shown in FIG. 17). Cord 168 is connected to hook 18 and second spool member 72 in the same way. Sleeve 217 may be secured over upper alignment plug 198, and sleeve 218 may be secured over lower alignment plug 200.

Figure 23:
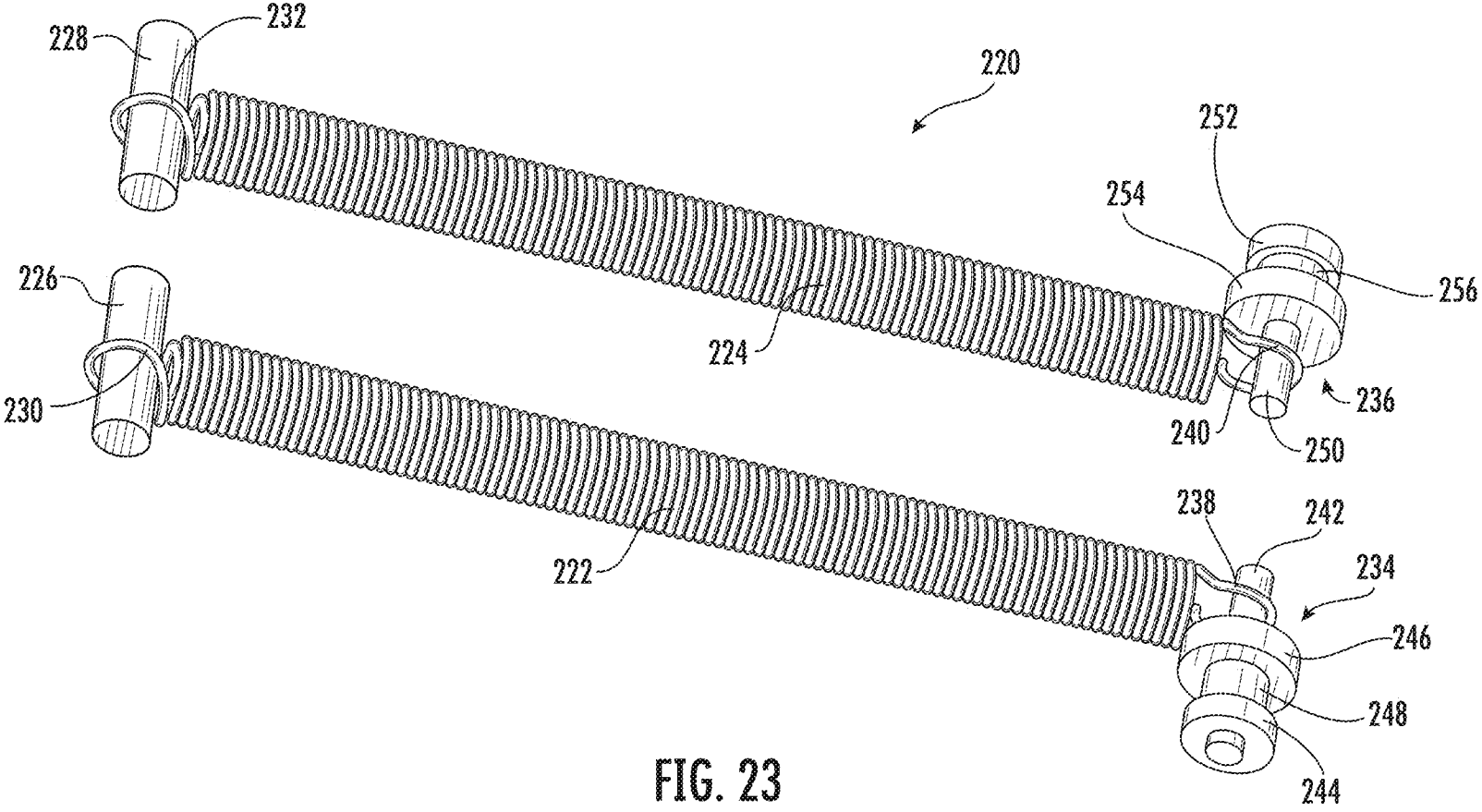
FIG. 23 is a perspective view of a return assist assembly.
Figure 24:
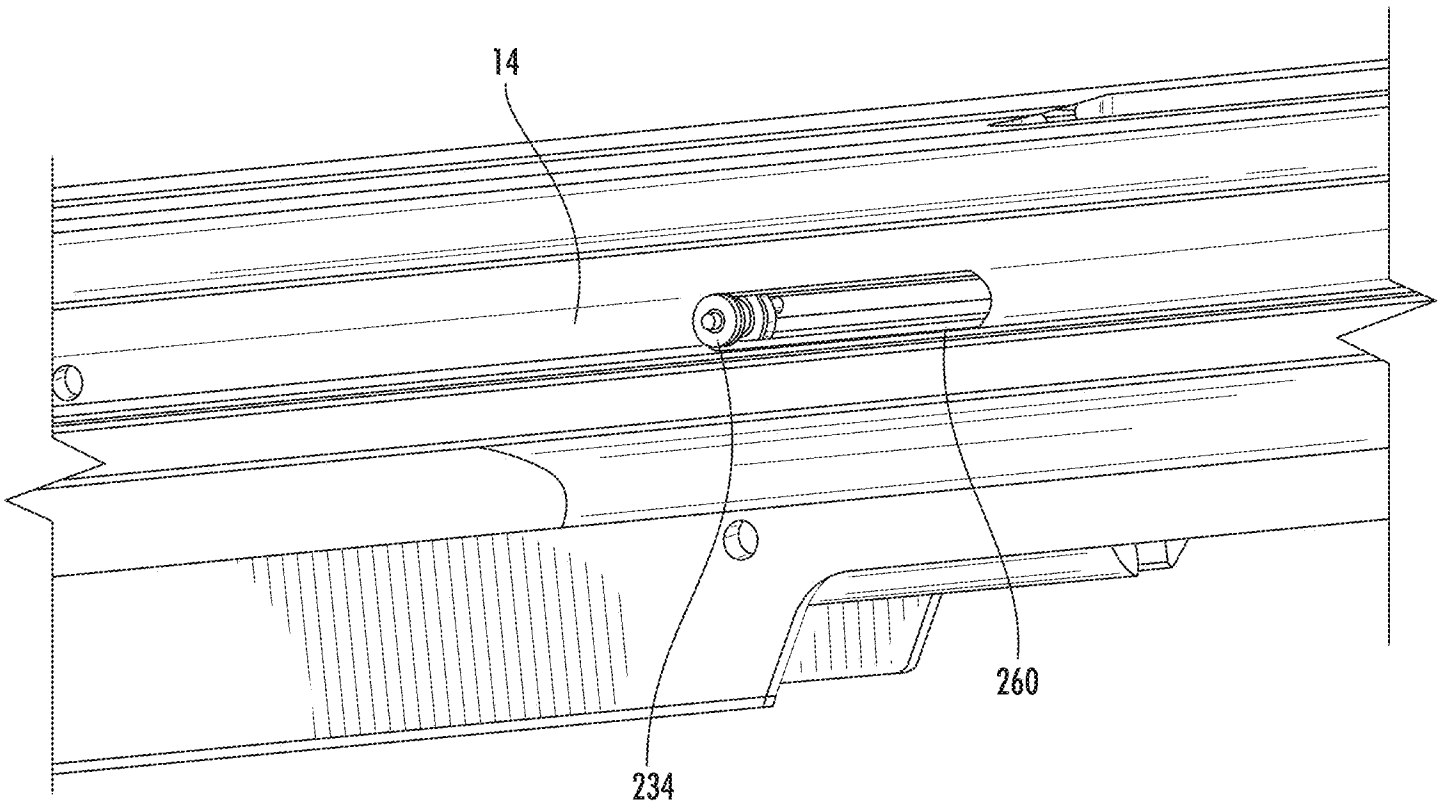
FIG. 24 is a side view of the return assist assembly in a crossbow stock.

With reference to FIG. 23, retractable cocking assembly 20 may further include return assist assembly 220 including springs 222 and 224. Each of the springs may be formed of a tension spring. Anchor pins 226 and 228 may be secured to first ends 230 and 232 of springs 222 and 224, respectively. The anchor pins may be secured to the first ends in any method known in the art. In one embodiment, each of the first ends include a loop or hook that is secured around one of the anchor pins. Anchor pins 226 and 228 may secure first ends 230 and 232 of springs 222 and 224 in a fixed position within a crossbow stock. Sliding pin assemblies 234 and 236 may be secured to second ends 238 and 240 of springs 222 and 224, respectively. Sliding pin assembly 234 includes axle pin 242, outer shoulder 244, inner shoulder 246, and sliding surface 248 between outer and inner shoulders 244 and 246. Similarly, sliding pin assembly 236 includes axle pin 250, outer shoulder 252, inner shoulder 254, and sliding surface 256 between outer and inner shoulders 252 and 254. Sliding pin assemblies 234 and 236 may each be secured within an elongated opening through the side of a crossbow track. FIG. 24 illustrates sliding pin assembly 234 in elongated opening 260 in crossbow track 14.

Figure 25:
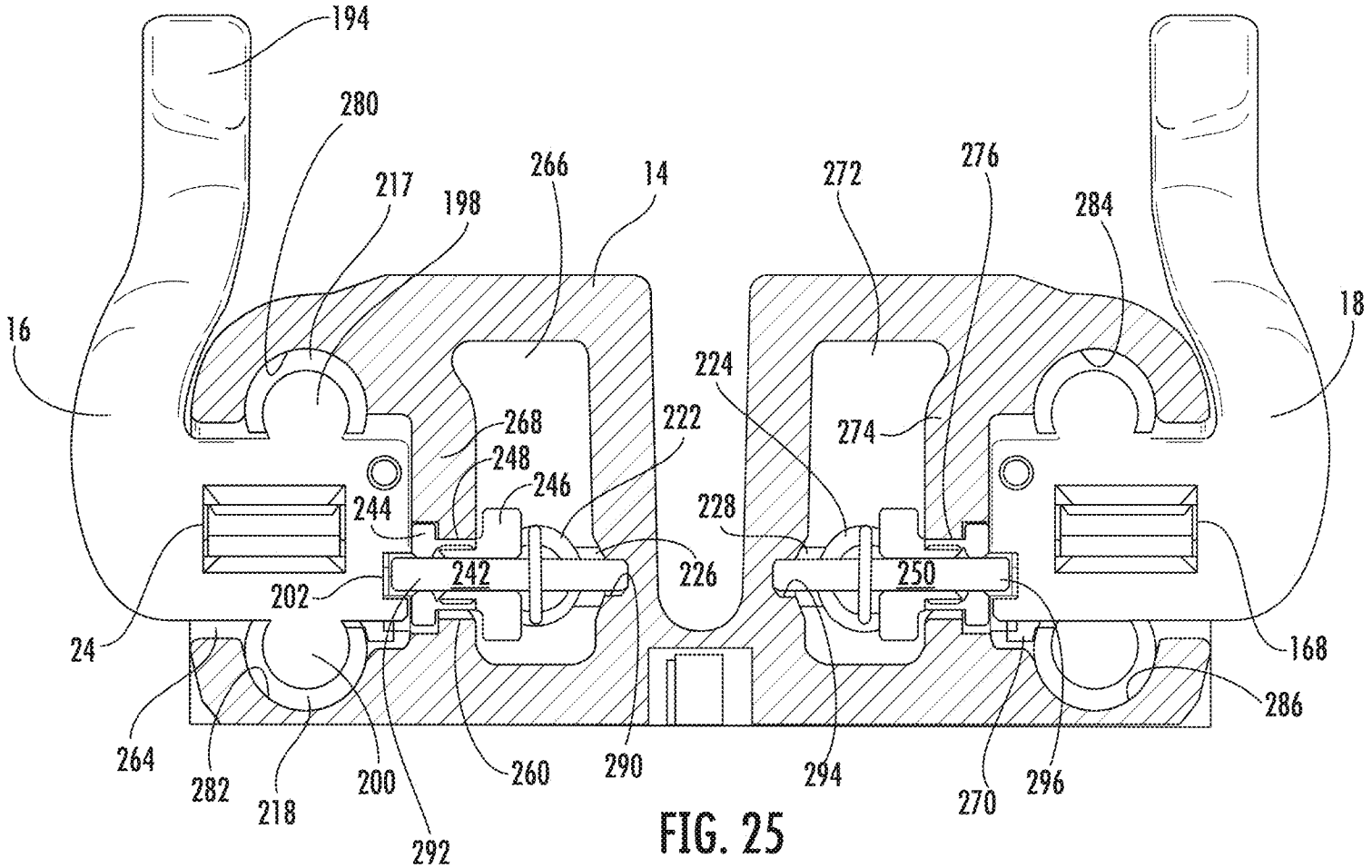
FIG. 25 is a sectional view of the return assist assembly in the crossbow stock.

As shown in FIG. 25, crossbow track 14 includes on one side an outer elongated cavity 264, an inner elongated cavity 266, and a longitudinal wall 268 separating the outer elongated cavity 264 and the inner elongated cavity 266. Elongated opening 260 is an opening in longitudinal wall 268 and connects outer and inner elongated cavities 264 and 266. The second side of crossbow track 14 includes an outer elongated cavity 270, an inner elongated cavity 272, and a longitudinal wall 274 separating the outer elongated cavity 270 and the inner elongated cavity 272. A second elongated opening 276 is formed in longitudinal wall 274 and connects outer and inner elongated cavities 270 and 272. Second elongated opening 276 is reciprocal to elongated opening 260 shown in FIG. 24.

Hooks 16 and 18 and return assist assembly 220 engage crossbow track 14. Hooks 16 and 18 slidably engage outer elongated cavities 264 and 270. Body 190 of hook 16 is slidingly disposed in outer elongated cavity 264 with hook extension 194 extending above an upper surface of track 14 for engaging a crossbow string above track 14. Upper alignment plug 198 with sleeve 217 and lower alignment plug 200 with sleeve 218 each slides in upper and lower grooves 280 and 282 of outer elongated cavity 264, respectively. The body portion of hook 18 is slidingly disposed in outer elongated cavity 270 with the hook extension of hook 18 extending above an upper surface of track 14 for engaging a crossbow string above track 14. The upper alignment plug with a sleeve of hook 18 and the lower alignment plug with a sleeve of hook 18 each slides in upper and lower grooves 284 and 286 of outer elongated cavity 270, respectively.

Return assist assembly 220 is generally disposed in inner elongated cavities 266 and 272 of crossbow track 14. Specifically, anchor pin 226 and spring 222 are disposed within inner elongated cavity 266, with anchor pin 226 secured to a fixed location therein. This connection may be accomplished with openings, grooves, or any other manner of securing a pin within a cavity. A first end of axle pin 242 of sliding pin assembly 234 is disposed in groove 290 in an internal wall of inner elongated cavity 266. Axle pin 242 extends through elongated opening 260 with second end 292 of axle pin 242 extending into outer elongated cavity 264 of crossbow track 14. Sliding surface 248 of sliding pin assembly 234 engages a reduced diameter portion of elongated opening 260. Outer shoulder 244 of sliding pin assembly 234 engages a shoulder between the reduced diameter portion and the expanded diameter portion of elongated opening 260, and inner shoulder 246 of sliding pin assembly 234 is disposed in inner elongated cavity 266.

Similarly, anchor pin 228 and spring 224 are disposed within inner elongated cavity 272, with anchor pin 228 secured to a fixed location therein. This connection may be accomplished with openings, grooves, or any other manner of securing a pin within a cavity. A first end of axle pin 250 of sliding pin assembly 236 is disposed in groove 294 in an internal wall of inner elongated cavity 272. Axle pin 250 extends through elongated opening 276 with second end 296 of axle pin 250 extending into outer elongated cavity 270 of crossbow track 14. Sliding surface 256 of sliding pin assembly 236 engages a reduced diameter portion of elongated opening 276. Outer shoulder 252 of sliding pin assembly 236 engages a shoulder between the reduced diameter portion and the expanded diameter portion of elongated opening 276, and inner shoulder 254 of sliding pin assembly 236 is disposed in inner elongated cavity 272.

Axle pins 242 and 250 are configured to slide along the length of elongated openings 260 and 276 in crossbow track 14, while hooks 16 and 18 are configured to slide in outer elongated cavities 264 and 270 along the entire or a substantial portion of the length of crossbow track 14. In a default position, sliding pin assemblies 234 and 236 are disposed at a forward end of elongated openings 260 and 276 (as shown in FIG. 24) and at a forward end of grooves 290 and 294, respectively. As hook 16 is drawn in a rearward direction, longitudinal groove 202 of hook 16 slides over second end 292 of axle pin 242 until stop surface 204 of hook 16 engages second end 292 of axle pin 242. As hook 16 is drawn further in a rearward direction, stop surface 204 of hook 16 pulls axle pin 242 in a rearward direction within elongated opening 260 and groove 290. Because first end 230 of spring 222 is secured to stationary anchor pin 226 and second end 238 is secured to sliding pin assembly 234, spring 222 is expanded as hook 16 pulls axle pin 242 in the rearward direction. Similarly, as hook 18 is drawn in a rearward direction, the longitudinal groove on the inside of hook 18 slides over second end 296 of axle pin 250 until the stop surface of hook 18 engages second end 296 of axle pin 250. As hook 18 is drawn further in a rearward direction, the stop surface of hook 18 pulls axle pin 250 in a rearward direction within elongated opening 276 and groove 294. Because first end 232 of spring 224 is secured to stationary anchor pin 228 and second end 240 is secured to sliding pin assembly 236, spring 224 is expanded as hook 18 pulls axle pin 250 in the rearward direction.

Figure 26:
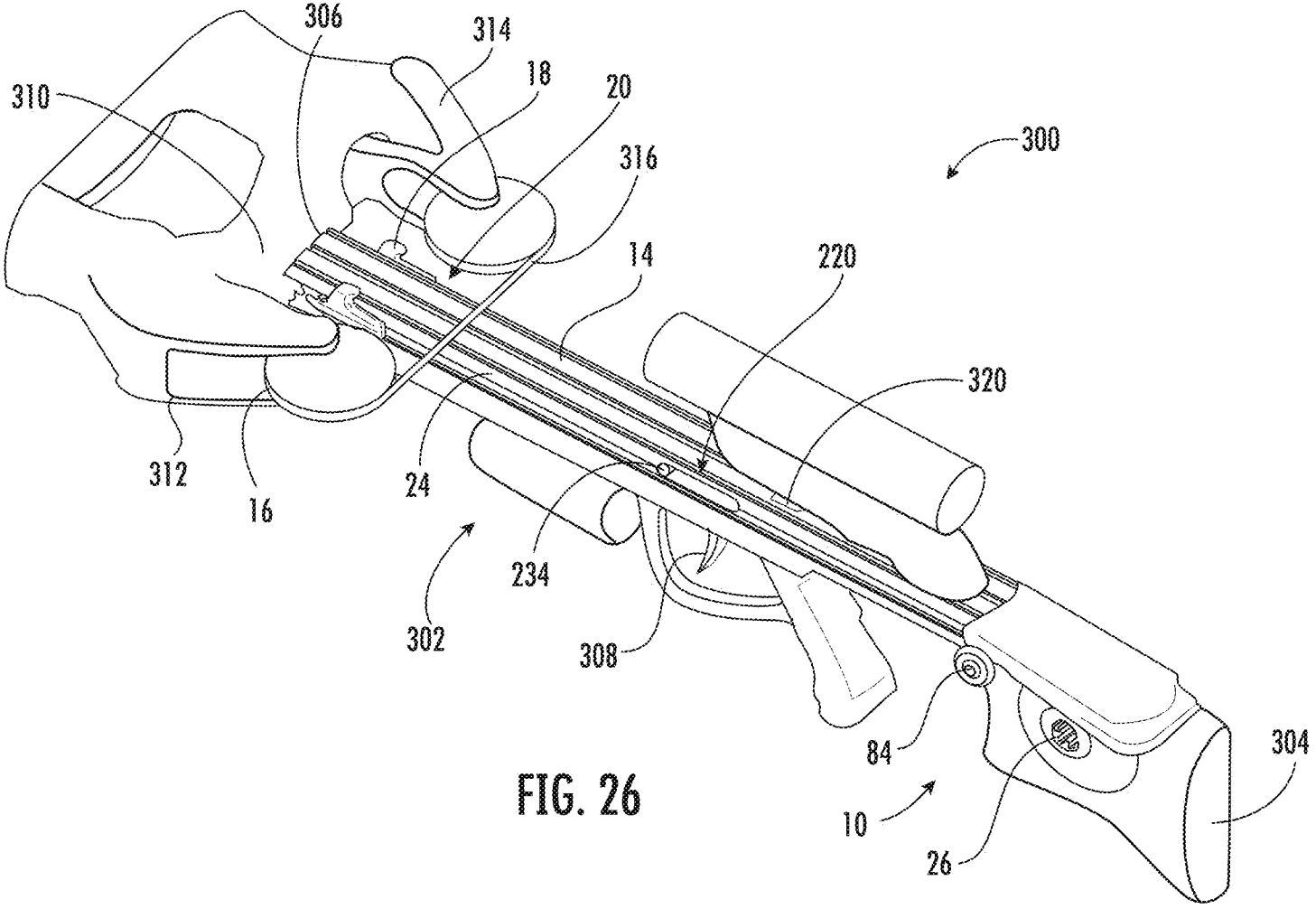
FIG. 26 is a perspective view of a crossbow including the worm gear CCD, the retractable cocking assembly, and the return assist assembly.

FIG. 26 illustrates crossbow 300 including crossbow stock 302 extending from butt end 304 to forward end 306. Crossbow stock 302 includes track 14 and trigger 308 disposed below track 14. Crossbow 300 also includes riser 310 secured to forward end 306 of crossbow stock 302. Bow limbs 312 and 314 are each secured to riser 310. Crossbow string 316 extends from a distal end of bow limb 312 above an upper surface of track 14 to a distal end of bow limb 314. CCD 10 is disposed within crossbow stock 302 near butt end 304. Crossbow 300 includes retractable cocking assembly 20 with return assist assembly 220. Retractable cocking assembly 20 is secured to crossbow track 14. First end 164 of cord 24 is secured to first spool member 70 as shown in FIG. 17, and the first end of second cord 168 is secured to second spool member 72 in CCD 10. Hooks 16 and 18 are positioned in front of crossbow string 316 in the uncocked default position shown in FIG. 26. Return assist assembly 220 is secured within track 14 with sliding pin assemblies 234 and 236 disposed within elongated openings 260 and 276 on each side of track 14 as shown in FIGS. 24 and 25.

In the default position illustrated in FIG. 26, crossbow string 316 is disposed near forward end 306 of crossbow stock 302. Crossbow 300 may be cocked using CCD 10 and retractable cocking assembly 20. A user may rotate receptacle 26 of CCD 10 with a crank tool having a profile that is reciprocal to the profile within receptacle 26. The rotation of receptacle 26 rotates primary gear assembly 30, worm assembly 32, and spool gear 74 as illustrated in FIGS. 2-6. The rotation of spool gear 74 with spool assembly 34 in the default position (shown in FIG. 6) rotates first and second spool members 70 and 72, which winds cords 24 and 168 around first and second spool members 70 and 72 thereby drawing hooks 16 and 18 in a rearward direction. As hooks 16 and 18 slide along track 14 in the rearward direction, hook extension 194 of hook 16 and the hook extension of hook 18 engage crossbow string 316. Further rotation of receptacle 26 continues to rotate first and second spool members 70 and 72 to pull hooks 16 and 18 along with crossbow string 316 further along track 14 in the rearward direction.

As hooks 16 and 18 are drawn in the rearward direction, the spring of spring assembly 170 and spring 184 of spring assembly 176 are expanded such that spring assemblies 170 and 176 apply a forward force on hooks 16 and 18 (i.e., spring assemblies 170 and 176 bias hooks 16 and 18 in a forward direction). If first and second spool members 70 and 72 are allowed to freely rotate, spring assemblies 170 and 176 would return hooks 16 and 18 to the default position near forward end 306 of crossbow stock 302, as shown in FIG. 26. As crossbow string 316 is pulled in the rearward direction by hooks 16 and 18, crossbow string 316 also applies a forward force against hook surface 196 of hook 16 and the hook surface of hook 18, which in turn applies a force on first and second spool members 70 and 72, which if unbalanced, would rotate first and second spool members 70 and 72 to unwind cords 24 and 168 to return crossbow string 316 to the default position. When the forward force is applied to first and second spool members 70 and 72 by crossbow string 316, release member 84 is disabled. In other words, release member 84 is fixed in the default position shown in FIG. 6 due to the interaction of block section 136 of key 76 with notch 144 of spool gear 74.

CCD 10 may provide an automatic locking feature. If the rotation of receptacle 26 is discontinued while crossbow string 316 is engaged by hooks 16 and 18, CCD 10 may prevent first and second spool members 70 and 72 from rotating freely in the opposite direction in response to forward pull by crossbow string 316 and spring assemblies 170 and 176. Instead, hooks 16 and 18 remain stationary with crossbow string 316 retained. This automatic locking feature of CCD 10 is provided by the interaction of worm outer surface 64 on worm sleeve 56 and the worm gear outer surface 140 on spool gear 74 (shown in FIGS. 5-6). Contributing factors may include friction, the shapes of worm outer surface 64 and worm gear outer surface 140, and the angle of interaction between worm sleeve 56 and spool gear 74.

However, the user may rotate receptacle 26 in the opposite direction to safely return crossbow string 316 to the default position. The rotation of receptacle 26 in the opposite direction rotates primary gear assembly 30, worm assembly 32, and spool gear 74 in the opposite direction. The rotation of spool gear 74 in the opposite direction with spool assembly 34 in the default position (shown in FIG. 6) rotates first and second spool members 70 and 72 in the opposite direction, which unwinds cords 24 and 168 thereby allowing crossbow string 316 and spring assemblies 170 and 176 to pull hooks 16 and 18 back into the default position near forward end 306 of crossbow stock 302.

If hooks 16 and 18 are pulled beyond sliding pin assemblies 234 and 236, second ends 292 and 296 of axle pins 242 and 250 are pulled along with hooks 16 and 18 in elongated openings 260 and 276 of track 14. As described above, this rearward movement of axle pins 242 and 250 expands springs 222 and 224 of return assist assembly 220.

To place the crossbow in a cocked position, the user may rotate receptacle 26 until hooks 16 and 18 pull crossbow string 316 into engagement with catch 320 of a trigger assembly in crossbow 300. Catch 320 retains crossbow string 316 in the cocked position, thereby removing the forward force applied by crossbow string 316 from hooks 16 and 18 and first and second spool members 70 and 72. When no force (i.e., no load) is applied to first and second spool members 70 and 72 by crossbow string 316, release member 84 is enabled such that a user may depress release member 84, which slides block section 136 of key 76 out of notch 144 of spool gear 74. This rotationally unlocks first and second spool members 70 and 72 from spool gear 74, which allows spring assemblies 170 and 176, along with springs 222 and 224 of return assist assembly 220, to draw hooks 16 and 18 forward into the default position near forward end 306 of crossbow stock 302 while crossbow string 316 is retained in catch 320 (i.e., in the cocked position). As described above, return assist assembly 220 provides an additional forward force on hooks 16 and 18 when release member 84 is depressed in order to begin the forward movement of hooks 16 and 18 even under any pinching effect created by the smaller angle of crossbow string 316 near catch 320 in the cocked position.

In this way, a user may rotate receptacle 26 to draw crossbow string 316 from an uncocked position into a cocked position using hooks 16 and 18. After crossbow string 316 is retained in catch 320 of the trigger assembly, the user may depress a release button (i.e., release member 84) to automatically retract hooks 16 and 18 into the default position. In the default position, hooks 16 and 18 are beyond the uncocked position of crossbow string 316 such that hooks 16 and 18 are safely removed from the path of crossbow string 316 when fired. Thereafter, a user may draw trigger 308 rearward to release crossbow string 316 from catch 320 in order to fire crossbow 300.

In one embodiment, the trigger assembly of crossbow 300 may include a safety mechanism that prevents trigger 308 from being pulled to fire crossbow string 316 if hooks 16 and 18 are not in the default position shown in FIG. 26 (i.e., if hooks 16 and 18 are within the path of crossbow string 316).

In another embodiment, the trigger assembly of crossbow 300 may include a release mechanism which allows catch 320 to release crossbow string 316 if hooks 16 and 18 are in position to retain crossbow string 316 in the same position near catch 320. In other words, the release mechanism prevents any need to dry fire crossbow 300 by providing for a safe method of uncocking crossbow 300. If crossbow 300 is cocked with crossbow string 316 retained in catch 320 and the user wishes to uncock the crossbow, the user may rotate receptacle 26 of CCD 10 to transfer hooks 16 and 18 rearward until reaching the cocked position of crossbow string 316. At that time, the release mechanism of the trigger assembly will be enabled and the user may engage the release mechanism to release crossbow string 316 from catch 320 to safely return crossbow string 316 into hooks 16 and 18. The user may then rotate receptacle 26 of CCD 10 in the opposite direction to safely return hooks 16 and 18 with crossbow string 316 to the default uncocked position shown in FIG. 26.

In an alternate embodiment, crossbow 300 includes retractable cocking assembly 20 without return assist assembly 220. In this embodiment, spring assemblies 170 and 176 alone draw hooks 16 and 18 forward into the default position when the user depresses release member 84.

In another alternate embodiment, crossbow 300 includes CCD 10 without retractable cocking assembly 20 (or return assist assembly 220). In this embodiment, a user may secure separate hooks to CCD 10 to cock the crossbow, and remove the separate hooks from the crossbow after it is cocked.

Crossbow 300 may include any assembly for positioning crossbow string 316 across crossbow track 14 behind hooks 16 and 18, even without riser 310, without bow limbs 312 or 314 as shown, without any bow limbs, or any combination thereof. For example, crossbow 300 may be a reverse crossbow, a compound crossbow, a reverse compound crossbow, or any other design configured to position crossbow string 316 behind hooks 16 and 18 in the default position.

Figure 27:
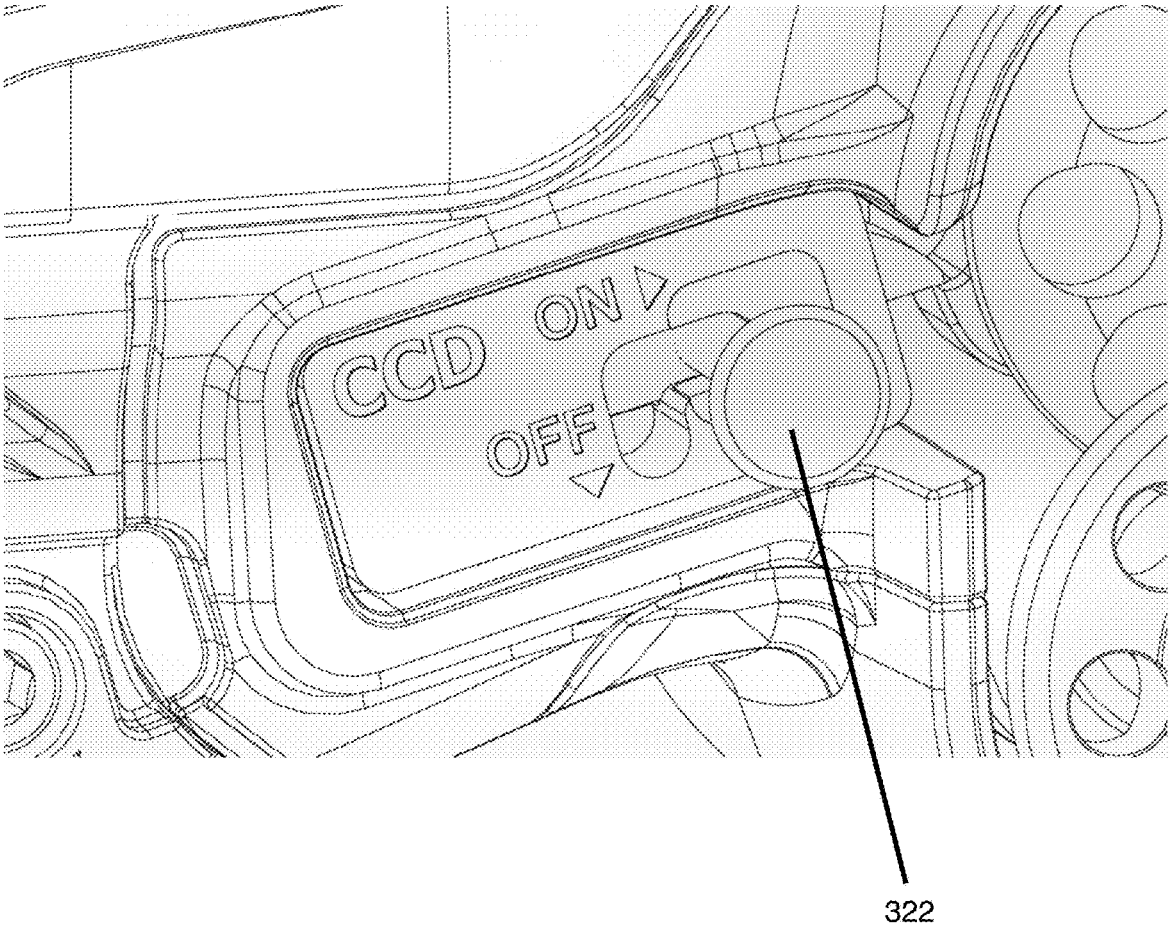
FIG. 27 is perspective view of an embodiment of the release mechanism of the cocking device.

FIG. 27 depicts an alternative embodiment in which release member 84 constitutes release lever 322. Release lever 322 may be adjusted by a user from an on position to an off position. In the on position, release lever 322 maintains the operative connection of hooks 16, 18 with the winding mechanism of CCD 10. In the off position, release lever 322 releases hook 16, 18 from the winding mechanism of CCD 10 so that hooks 16, 18 are able to move forward on crossbow track 14 to their default or non-actuated position.

Figure 28:
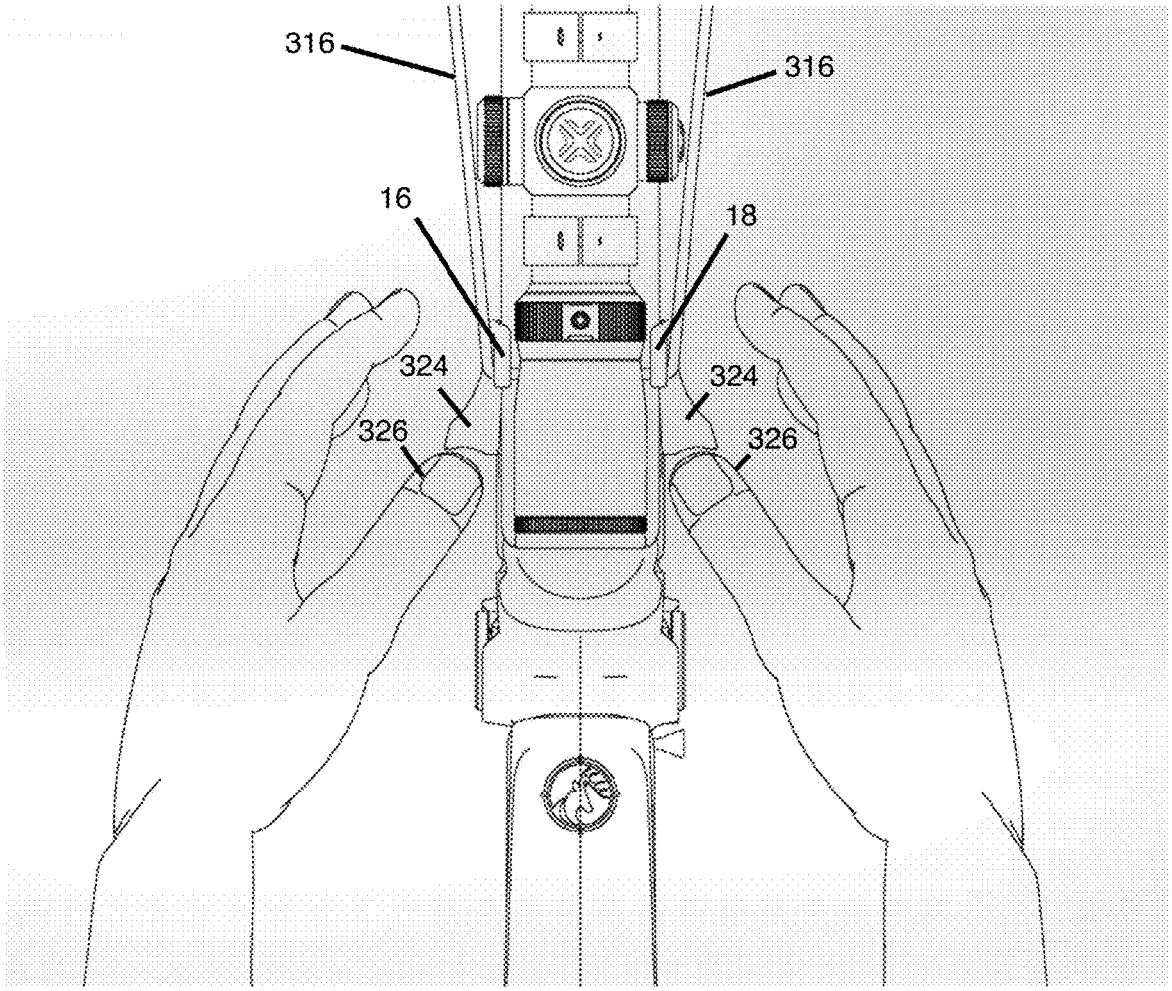
FIG. 28 is a top view of the hook members in the actuated position.

FIG. 28 illustrates that hooks 16, 18 each include extension 324. Extensions 324 may be shaped for placement of a user's thumb or other digit. For example, extensions 324 may be concaved shaped. A user may place the user's thumbs 326 on extensions 324 to push hooks 16, 18 forward to overcome any pinching effect caused by bowstring 316 when cocked and thereby permit spring assemblies 170 to return hooks 16, 18 to their default or non-actuated position.

Figure 29:
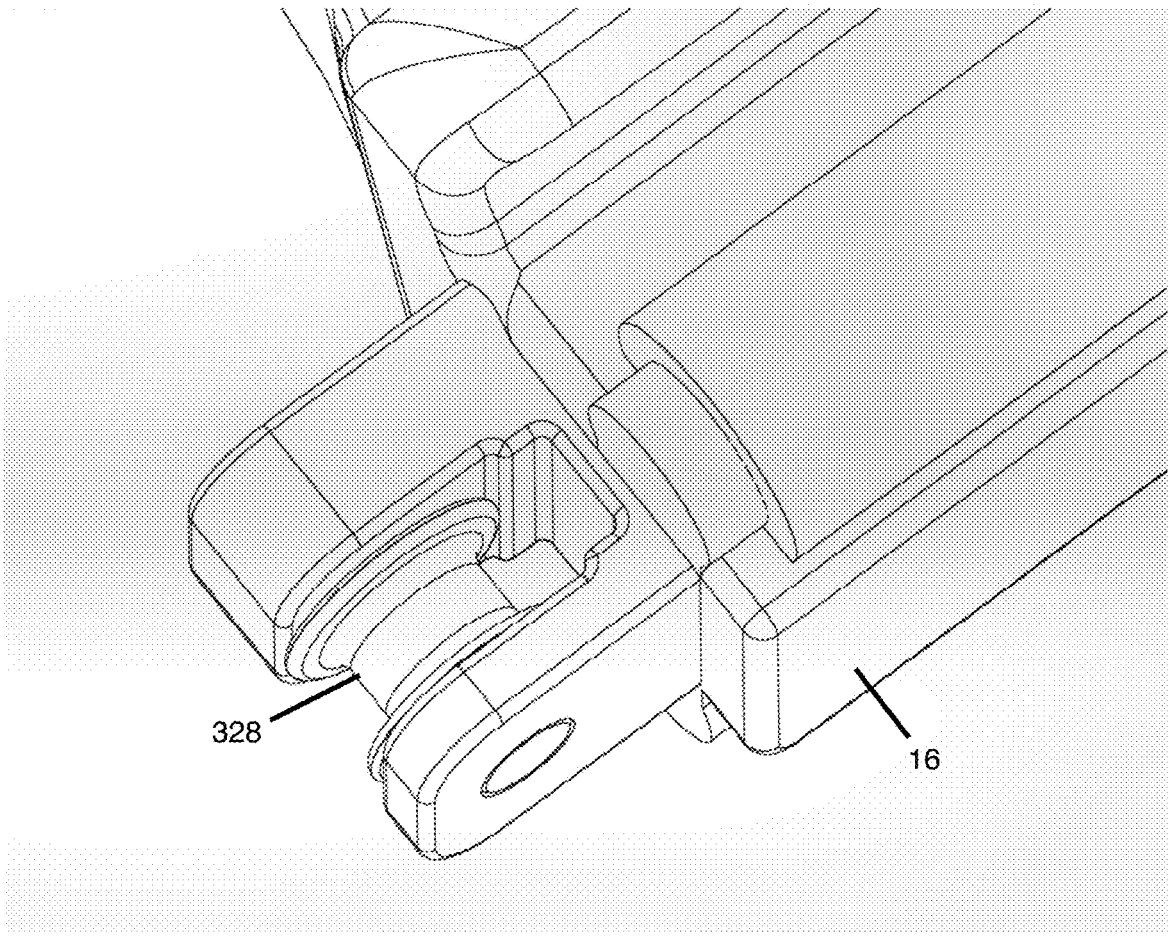
FIG. 29 is a partial perspective view of an embodiment of a hook member.

FIG. 29 shows an embodiment of hooks 16 including a pulley mechanism 328. It is to be understood that hook 18 also includes pulley mechanism 328. If crossbow 300 is equipped with hooks 16, 18 having pulley mechanisms 328, a single cord 24 may be employed in a block and tackle arrangement to connect to both hooks 16, 18 to CCD 10 such that when CCD 10 is activated to retract single cord 24, single cord 24 functions to move hooks 16, 18 rearward on crossbow track 14 to position bowstring 316 in the cocked position. In the block and tackle arrangement, single cord 24 from spool 72 in CCD 10 is fed through pulley mechanism 328 in hook 16, single cord 24 is wrapped back through crossbow track 14, single cord 24 is fed through pulley mechanism 328 in hook 18, and single cord 24 extends to spool 70 of CCD 10. The use of single cord 24 reduces the load placed upon CCD 10 by about 50%.

Each assembly described herein may include any combination of the described components, features, and/or functions of each of the individual assembly embodiments. Each method described herein may include any combination of the described steps in any order, including the absence of certain described steps and combinations of steps used in separate embodiments. Any range of numeric values disclosed herein shall be construed to include any subrange therein.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A crossbow comprising:

a stock having a forward end and a rearward end, the stock including a top side, a bottom side, and left and right sides interconnecting the top and bottom sides;

a track including a top side, a bottom side, and left and right sides interconnecting the top and bottom sides, the bottom side of the track being operatively connected to the top side of the stock, the track extending from a front end positioned at the forward end of the stock to a rear end extending rearward of a catch; the top side of the track configured to position a projectile for firing;

a trigger assembly including a trigger, the trigger being operatively associated with the catch, the catch operatively positioned above the track, the catch configured to retain a bowstring in a cocked position and to release the bowstring for firing the projectile;

a riser operatively affixed at the forward end of the stock, the riser including a left side section and a right side section;

a first bow limb operatively connected to the left side section of the riser and a distal end;

a second bow limb operatively connected to the right side section of the riser and a distal end;

the bowstring operatively connected between first and second bow strings and traversing above the top side of the track;

a retractable cocking assembly including a first hook member operatively associated with a first return mechanism and a second hook member operatively associated with a second return mechanism, the first and second hook members each including a hook extension configured to retain the bowstring, the first hook member slidably affixed to the left side of the track between a non-actuated position wherein the first hook member is situated forward of the bowstring in an uncocked position and an actuated position wherein the first hook member is situated adjacent the catch so that the catch retains the bowstring in the cocked position for firing, the second hook member slidably affixed to the right side of the track between a non-actuated position wherein the second hook member is situated forward of the bowstring in the uncocked position and an actuated position wherein the second hook member is situated adjacent the catch so that the catch retains the bowstring in the cocked position for firing, the first return mechanism including a first biasing member, the first biasing member operatively connected to the first hook member and configured to move the first hook member from the actuated position to the non-actuated position, the second return mechanism including a second biasing member, the second biasing member operatively connected to the second hook member and configured to move the second hook member from the actuated position to the non-actuated position;

a cocking device including a first cord, a second cord and a winding assembly, the first and second cords each having a first end operatively connected to the winding assembly and a second end, the second end of the first cord being operatively connected to the first hook member, the second end of the second cord being operatively connected to the second hook member, the winding assembly being configured to wind the first and second cords to cause the first and second hook members to move from the non-actuated position to the actuated position;

wherein the first and second hook members each has a forward surface, a rearward surface, a top side, a bottom side, an outer side, and an inner side, the hook extension extending from the top side;

wherein the first and second hook members each includes a bore, the bore of the first hook member dimensioned to accommodate the second end of the first cord, and the bore of the second hook member dimensioned to accommodate the second end of the second cord;

wherein the hook extension of each of the first and second hook members has a front side, a rear side, an external side and an internal side, and wherein the first and second hook members each includes an insertion section extending inwardly from the internal side of the hook extension;

wherein the left and right sides of the track each includes a first cavity defined by an internal cavity wall, the first cavity extending from a point on the track forward of the bowstring in the uncocked position to at least a point on the track below the catch, and wherein the insertion section of the first hook member is profiled for accommodation within the first cavity of the left side of the track and the insertion section of the second hook member is profiled for accommodation within the first cavity of the right side of the track; and wherein the profile of the insertion section of the first hook member includes an upper alignment plug positioned on the top side of the first hook member, wherein an upper side of the internal cavity wall of the first cavity of the left side of the track includes a profile shaped to accommodate the upper alignment plug of the first hook member in sliding relationship, and wherein the profile of the insertion section of the second hook member includes an upper alignment plug positioned on the top side of the second hook member, wherein an upper side of the internal cavity wall of the first cavity of the right side of the track includes a profile shaped to accommodate the upper alignment plug of the second hook member in sliding relationship.

2. The crossbow of claim 1, wherein the bore in the first hook member extends from the rearward surface of the first hook member and terminates adjacent a first pin groove, the first pin groove retaining a first pin, the second end of the first cord being fixedly attached to the first pin, and wherein the bore in the second hook member extends from the rearward surface of the second hook member and terminates adjacent a second pin groove, the second pin groove retaining a second pin, the second end of the second cord being fixedly attached to the second pin.

3. The crossbow of claim 1, wherein the profile of the insertion section of the first hook member includes a lower alignment plug positioned on the bottom side of the first hook member, wherein a lower side of the internal cavity wall of the first cavity of the left side of the track includes a profile shaped to accommodate the lower alignment plug of the first hook member in sliding relationship, and wherein the profile of the insertion section of the second hook member includes a lower alignment plug positioned on the bottom side of the second hook member, wherein a lower side of the internal cavity wall of the first cavity of the right side of the track includes a profile shaped to accommodate the lower alignment plug of the second hook member in sliding relationship.

4. The crossbow of claim 3, wherein the upper and lower alignment plugs of the first and second hook members each includes an outer sleeve.

5. The crossbow of claim 1, wherein the bore of the first hook member is positioned within the insertion section of the first hook member, and wherein the bore of the second hook member is positioned within the insertion section of the second hook member.

6. The crossbow of claim 1, wherein the cocking device includes a release mechanism configured to release the first and second cords so that the first and second biasing members are able to move the first and second hook members to the non-actuated position.

7. The crossbow of claim 1, further comprising a return assist assembly, the return assist assembly comprising a push extension on each of the first and second hook members, each push extension configured to receive a digit from a user, the user pushing on the push extension of each of the first and second hook members to cause an initial forward movement of the first and second hook members from the actuated position to enable the first and second biasing members of the return mechanism to return the first and second hook members to the non-actuated position.

8. The crossbow of claim 1, wherein the first biasing member includes a first spring, and wherein the second biasing member includes a second spring.

9. The crossbow of claim 8, wherein the first and second springs are each a constant force spring.

10. The crossbow of claim 8, wherein the first and second springs are each a clock spring.

11. The crossbow of claim 10, wherein the clock spring is formed of a spring steel.

12. The crossbow of claim 8, wherein the first biasing member includes a first housing containing the first spring, and wherein the second biasing member includes a second housing containing the second spring.

13. The crossbow of claim 12, wherein the first spring of the first biasing member has a first end operatively connected within the first housing and a second end operatively connected to the first hook member, and wherein the second spring of the second biasing member has a first end operatively connected within the second housing and a second end operatively connected to the second hook member.

14. The crossbow of claim 13, wherein the first housing includes a first top section, the first top section configured to operatively receive the first hook member when the first hook member is in the non-actuated position, and wherein the second housing includes a second top section, the second top section configured to operatively receive the second hook member when the second hook member is in the non-actuated position.

* * * * *